US005864058A

United States Patent [19]

Chen

[11] Patent Number: 5,864,058

[45] Date of Patent: Jan. 26, 1999

[54] DETECTING AND REDUCING BIT WHIRL

[75] Inventor: Chen-Kang David Chen, Houston, Tex.

[73] Assignee: Baroid Technology, Inc., Houston, Tex.

[21] Appl. No.: 881,930

[22] Filed: Jun. 25, 1997

Related U.S. Application Data

[63] Continuation of Ser. No. 311,476, Sep. 23, 1994, abandoned.

[51] Int. Cl.[6] ..... E21B 44/00; E21B 12/02

[52] U.S. Cl. ..... 73/152.47; 175/39

[58] Field of Search ..... 73/587, 152.43, 73/152.46, 152.47, 152.48, 152.58; 175/39, 40

[56] References Cited

U.S. PATENT DOCUMENTS

| | | | |
|---|---|---|---|
| Re. 34,435 | 11/1993 | Warren | 175/398 |
| 4,627,276 | 12/1986 | Burgess et al. | 73/151 |
| 4,695,957 | 9/1987 | Peltier | 364/422 |
| 4,715,451 | 12/1987 | Bseisu et al. | 175/40 |
| 4,773,263 | 9/1988 | Lesage et al. | 73/151 |
| 4,821,563 | 4/1989 | Maron | 73/151 |
| 4,905,776 | 3/1990 | Beynet | 175/56 |
| 4,928,521 | 5/1990 | Jardine | 73/151 |
| 4,932,484 | 6/1990 | Warren | 175/431 |
| 4,958,517 | 9/1990 | Maron | 73/151 |
| 4,982,802 | 1/1991 | Warren | 175/57 |
| 5,042,596 | 8/1991 | Brett | 175/57 |
| 5,058,077 | 10/1991 | Twist | 367/25 |
| 5,111,892 | 5/1992 | Sinor | 175/65 |
| 5,119,892 | 6/1992 | Clegg | 175/431 |
| 5,131,478 | 7/1992 | Brett | 175/57 |
| 5,159,836 | 11/1992 | Close et al. | 73/660 |
| 5,186,268 | 2/1993 | Clegg | 175/399 |
| 5,201,292 | 4/1993 | Grajski et al. | 123/425 |
| 5,213,168 | 5/1993 | Warren | 175/61 |
| 5,245,871 | 9/1993 | Henneuse et al. | 73/151 |
| 5,309,765 | 5/1994 | Horigome et al. | 73/602 |
| 5,313,829 | 5/1994 | Paslay | 73/151 |
| 5,402,677 | 4/1995 | Paslay et al. | 73/151 |
| 5,415,030 | 5/1995 | Jogi et al. | 73/151 |
| 5,448,911 | 9/1995 | Mason | 73/151 |
| 5,469,736 | 11/1995 | Moake | 73/152.58 |
| 5,531,281 | 7/1996 | Murdock | 175/431 |
| 5,560,439 | 10/1996 | Delwiche | 175/325.1 |
| 5,568,838 | 10/1996 | Struthers | 175/246 |
| 5,582,247 | 12/1996 | Brett | 166/249 |
| 5,586,612 | 12/1996 | Isbell | 175/353 |
| 5,649,604 | 7/1997 | Fuller | 175/431 |

OTHER PUBLICATIONS

Brett et al "Bit Whirl—A New theory of PDC Bit Failure," paper SPE 19571, 1989 SPE Annual Technical Conference and Exhibition, San Antonio, Oct. 8–11, 1989.

Brett et al "Bit Whirl—A New theory of PDC Bit Failure," SPE Drilling Engineering, Dec. 90, pp. 275–281.

*Primary Examiner*—Michael Brock
*Assistant Examiner*—Jay L. Politzer
*Attorney, Agent, or Firm*—Browning Bushman

[57] ABSTRACT

A downhole sensor sub is provided in the lower end of a drillstring, such sub having three orthogonally positioned accelerometers for measuring vibration of a drilling component such as the drill bit and/or the bottom hole assembly (BHA) along the X, Y and Z axes. The lateral acceleration is measured along either the X or Y axis and then analyzed in the frequency domain as to peak frequency and magnitude at such peak frequency. Backward whirling of the drilling component is indicated when the magnitude at the peak frequency exceeds a predetermined value. A low whirling frequency accompanied by a high acceleration magnitude based on empirically established values is associated with destructive vibration of the drilling component. One or more drilling parameters (weight on bit, rotary speed, etc.) is then altered to reduce or eliminate such destructive vibration.

17 Claims, 25 Drawing Sheets

60

74
FILTER AND PROCESSING SYSTEM
73
77
62
66
P
72
68
76
70
23
23
MUD PIT
10
64
50

DETECTING AND REDUCING BIT WHIRL

This is a continuation of U.S. application Ser. No. 08/311,476, filed on Sep. 23, 1994 now abandoned.

BACKGROUND OF THE INVENTION

The present invention relates, generally, to a new and improved method for detecting the whirl of a drill bit, and/or the whirl of the Bottom Hole Assembly (BHA) in a drillstring used to drill oil and gas wells, and for reducing such whirl or whirls. As is well known in this art, "whirl" is used to describe the rotational motion of a bit, BHA or the drillstring itself, in which the bit, for example, is rotating at a different rotational velocity with respect to the borehole wall than it would be rotating if the bit axis were stationary. This precessional movement may be faster, or slower than the case where the bit axis is stationary. If faster, it is considered forward whirl; if slower, it is considered backward whirl.

Roller cone bits have been associated with axial vibrations since the first downhole measurements of forces and accelerations were first published. Measurements made while drilling with 3-cone bits have consistently and historically displayed axial vibrations at a frequency of 3 times the rotary speed, and when vibrations were severe the bit was observed to bounce. Cores have suggested that the vibrations are generated by a cammed bottom hole pattern, but it has not been determined whether this is the cause of the vibrations, or merely an effect.

The vibrations associated with polychrystalline diamond compact (PDC) bits are somewhat different than those of roller cone bits. Stick-slip torsional vibration of the drill string may be generated by dull PDC bits. PDC bits also vibrate laterally due to backward whirl. When this happens, the bit instantaneously rotates about some point other than the center of the borehole, and the point itself travels in a counter-clockwise direction around the borehole. Backward whirl has been identified as a primary contributor to the damage of PDC cutters, and simulation results suggest that its effects are amplified by torsional oscillations. Ways to mitigate this behavior have been investigated, and the most effective technique has become the basis for a popular commercial product line of PDC bits (anti-whirl bits), for example, as discussed in the SPE Paper No. 24614 entitled "Directional and Stability Characteristics of Anti-Whirl Bits With Non-Axisymmetric Loading", presented at the Annual Technical Conference and Exhibition, Washington, D.C., Oct. 4–7, 1992, by Pastusek, P. E., Cooley, C. H., Sinor, L. A. and Anderson, M.

Vibrations generated by the bit combine with those due to other sources, such as mass imbalance and wellbore friction, during drilling and reaming operations. The results are axial, lateral, and torsional vibrations of the drill string, which are believed to be a fundamental cause of drill string failures. Mathematical models have been developed by those in the art to identify and avoid operating parameters which lead to damaging downhole behaviors, but the complexity of the downhole environment limits the accuracy of model predictions.

In recent years modelling efforts have given way to monitoring efforts, as surface and downhole measurements have been used to identify harmful operating conditions. When sensors indicate that vibration levels have exceeded some safe level, the weight on bit and /or rotary speed are adjusted. If adjustments are not effective, and component failures are imminent, then the drill string must be pulled and its design modified.

PRIOR ART

It is known in the prior art to monitor the downhole vibrations of a drillstring, for example, as set forth in U.S. Pat. No. 4,903,245 to David A. Close, et al, which describes the use of at least one accelerometer in a BHA for monitoring downhole vibrations.

As yet another example of the prior art, U.S. Pat. No. 4,773,263 to Marc Lesage, et al, describes the use of frequency spectra of the downhole acceleration for measuring bit vibrations associated with bit tooth wear, rock hardness and less-than-perfect bit cleaning while drilling.

An even earlier patent, U.S. Pat. No. 4,150,568 to Eugene L. Berger, et al, describes the use of at least one accelerometer in a BHA to monitor downhole vibrations.

In still another aspect of the prior art, U.S. Pat. No. 5,159,577 to James R. Twist, assigned to Baroid Technology, Inc. the assignee of the present invention, there is described the use of a nuclear type of detector which is used to monitor the whirling condition of a drill collar, which in turn leads to the altering of one or more drilling parameters in response to the monitoring process.

In yet another portion of the prior art, U.S. Pat. No. 4,958,125 to Sturt Jardine, et al, there is disclosed a system in which lateral shocks and the rotary speed of the drillstring are measured.

In addition to the foregoing, the following represent the state of the art:

U.S. Pat. No. 5,321,981, Methods for Analysis of Drillstring Vibration Using Torsionally Induced Frequency Modulation, John D. Macpherson, Jun. 21, 1994.
This patent describes the use of frequency modulation to detect torsional vibration of the drill string.

U.S. Pat. No. 5,226,332, Vibration Monitoring System for Drillstring, Mark E. Wassell, Jul. 13, 1993
This patent describes the use of four acceleration measurements for detecting lateral, torsional and longitudinal drillstring vibrations. Three accelerometers are used to measure lateral and torsional vibrations and the fourth accelerometer measures the longitudinal vibration.

European Patent No. 0,553,908, A2, Method of and Apparatus for Making Near-Bit Measurements While Drilling, Orban Jacques, Apr. 8, 1993
This invention presents a MWD sub positioned near the bit to measures various downhole parameters such as inclination, but has no discussion of handling vibration data.

European Patent No. 0,550254, A2, Method of Determining Drillstring Bottom Hole Assembly Vibrations, Paul R. Paslay, Jul. 7, 1993
This patent provided a method for predicting lateral vibrations of the bottom hole assembly by measuring longitudinal and torsional movement at the top of the drillstring.

PDC Bit Dynamics, C. J. Langeveld, 1992 IADC/SPE Drilling Conference, February, 1992
This paper presents a three-dimensional PDC model.

Whirl and Chaotic Motion of Stabilized Drill Collars J. D. Jansen, SPE Drilling Engineering, June, 1992
This paper presents a simulation model for predicting the motion for a 2-stabilizer BHA during forward and backward whirl U.S. Pat. No. 5,141,061, Method and Equipment for Drilling Control by Vibration Analysis, Henry Henneuse, Aug. 25, 1992

This patent teaches the use of an accelerometer to measure bit vibrations. No information is given about data interpretation and the application.

U.S. Pat. No. 4,964,087, Seismic Processing and Imaging with a Drill Bit Source, Bernard Widrow, Oct. 16, 1990
This patent deals primarily with the application of seismic wave on determining the drill bit position.

Bit Whirl—A New Theory of PDC Bit Failure, J. Ford Brett, Thomas M. Warren, and Suzanne M. Behr, SPE Drilling Engineering, December 1990
This paper shows a general description of the motion of PDC bit whirl.

U.S. Pat. No. 4,715,451, Measuring Drilistem Loading and Behavior, Amjad J. Beelum, et. al., Dec. 29, 1987
This patent is involved exclusively with the surface measurements.

SUMMARY OF THE INVENTION

The objects of the present invention are accomplished, generally, by a method of measuring the lateral acceleration of a drilling component such as the drill bit or the bottom hole assembly, and by determining the frequency having the greatest magnitude and the magnitude itself at such peak frequency, and comparing such determined magnitude with a predetermined level to thereby determine whether such drilling component is backwardly whirling. As an additional feature of the invention, one or more drilling parameters is varied based upon such determination of backward whirling to reduce or eliminate such whirling. As another feature of the invention, means are provided for determining the whirling frequency of a backwardly whirling drilling component.

DESCRIPTION OF PREFERRED EMBODIMENT

A series of tests were conducted using a laboratory drilling machine to examine the dynamics of drill bits under controlled conditions. Three varieties of 8-½" bits (anti-whirl PDC, 4-bladed conventional PDC, and roller cone) were tested to capture a range of bit motions. Each bit was tested in at least two types of rock. The first (Indiana limestone) had an unconfined uniaxial compressive strength (co) of 8,000 psi, and is referred to in the remainder of this discussion as the soft rock; the second (Carthage limestone) had a co of 18,000 psi, and is referred to as the hard rock. The tests were conducted by establishing a weight on bit (WOB) at a given rotary speed (RPM), holding for a period of time, incrementing the rotary speed, and so on. The tests were run without the end cap on the cell which contains the core to remove its constraint on the lateral motion of the drill bit.

The operating parameters, test cell side loads, and test cell accelerations were measured via existing laboratory instrumentation. Bit vibrations were measured by a commercial Drillstring Dynamics Sensor (DDS) sub, which was located 6 feet from the bit. The sub included two lateral accelerometers (X, Y) and an axial accelerometer (Z). Accelerometer orientation within the tool caused the X and Y accelerometers to be sensitive to radial and tangential accelerations, respectively, as well as lateral components. The tool provided high rate acceleration data (1000 samples per second), as well as peak and average data (4 second sampling periods).

The DDS sub is described in depth in the SPE Paper No. 26341 presented at the Annual Technical Conference and Exhibition in Houston, Tex. on Oct. 6–9, 1993, by Zannoni, S. A.; Cheatum, C. A.; Chen, D. C. K. and Golla, C. A., incorporated herein in its entirety by reference.

Laboratory Test Results

Anti-Whirl PDC Bit

Figure 1A:
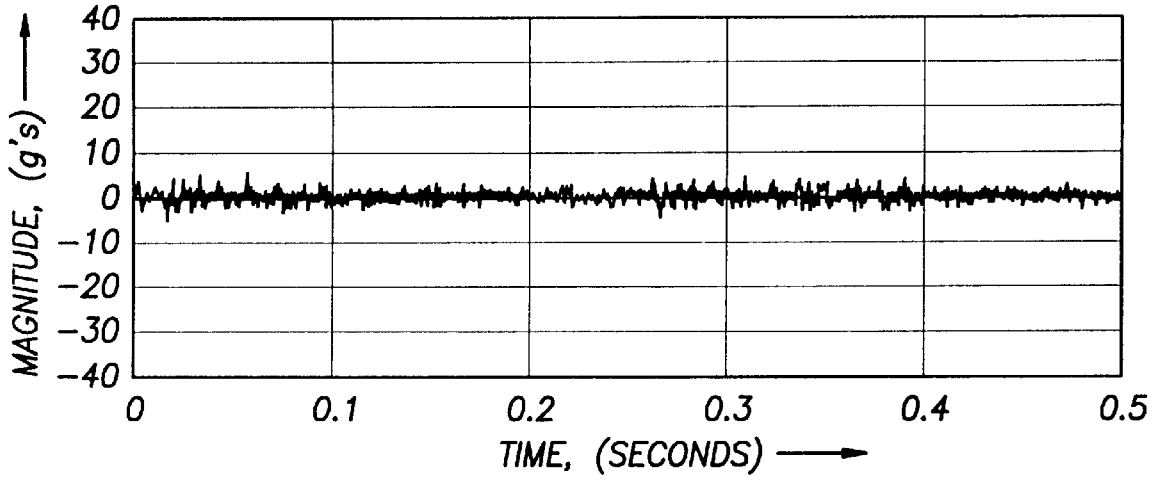
FIG. 1 represents graphs showing high sampling rate accelerations measured in accord with the present invention for an anti-whirl PDC bit in hard rock at 240 RPM and 1.5 klbf WOB.
Figure 1B:
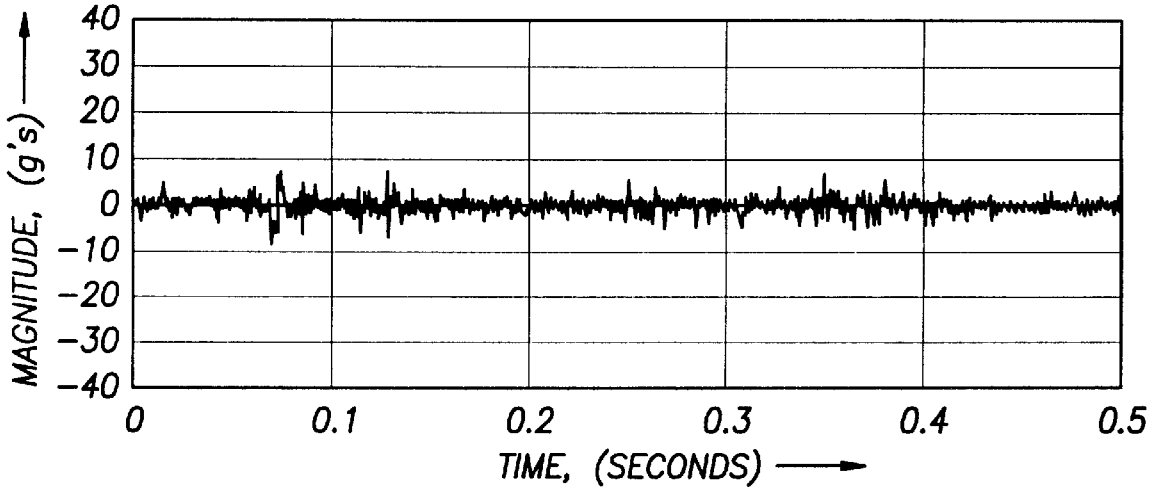

Drilling with the anti-whirl bit in both the hard and soft rock appeared to be stable and smooth. FIG. 1 illustrates the lateral accelerations measured by the DDS while drilling through the hard rock at 240 RPM and 1.5 thousand pound force (klbf) WOB. The maximum amplitude was less than 5 g, and even smaller amplitudes (1 g) were measured while drilling the soft rock. The axial (Z) accelerations were near zero for both rocks. The bottom hole patterns which remained after the tests were in gauge i.e., were not enlarged or eccentrically shaped, and consisted of concentric circular grooves. These indicated that the center of rotation was fixed at the center of the hole, which typifies smooth (non-whirling) drilling.

Conventional PDC Bit

Figure 2A:
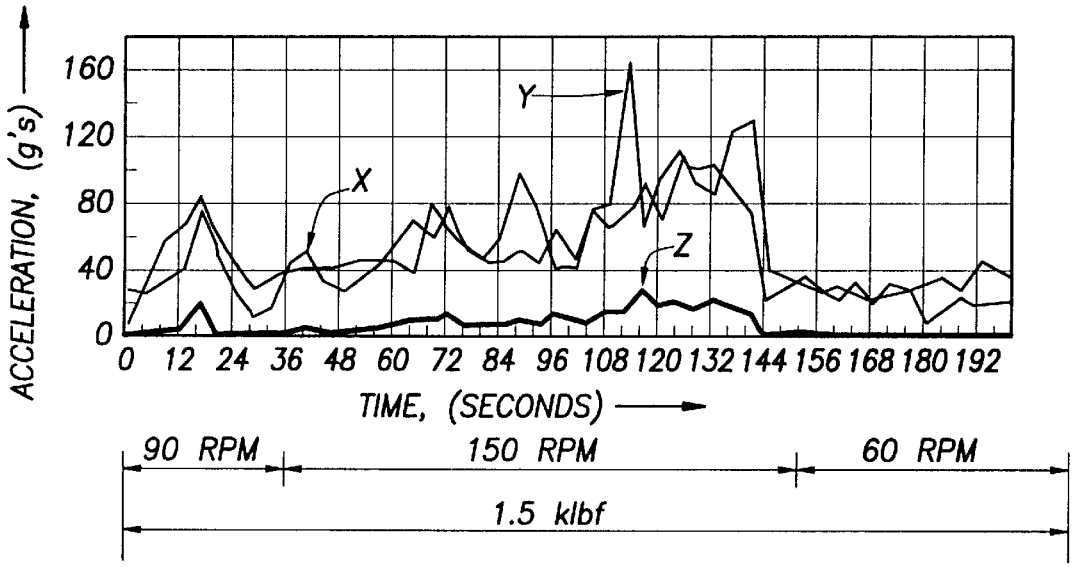
FIG. 2 represents graphs of peak and average accelerations for a conventional PDC bit in soft rock.
Figure 2B:
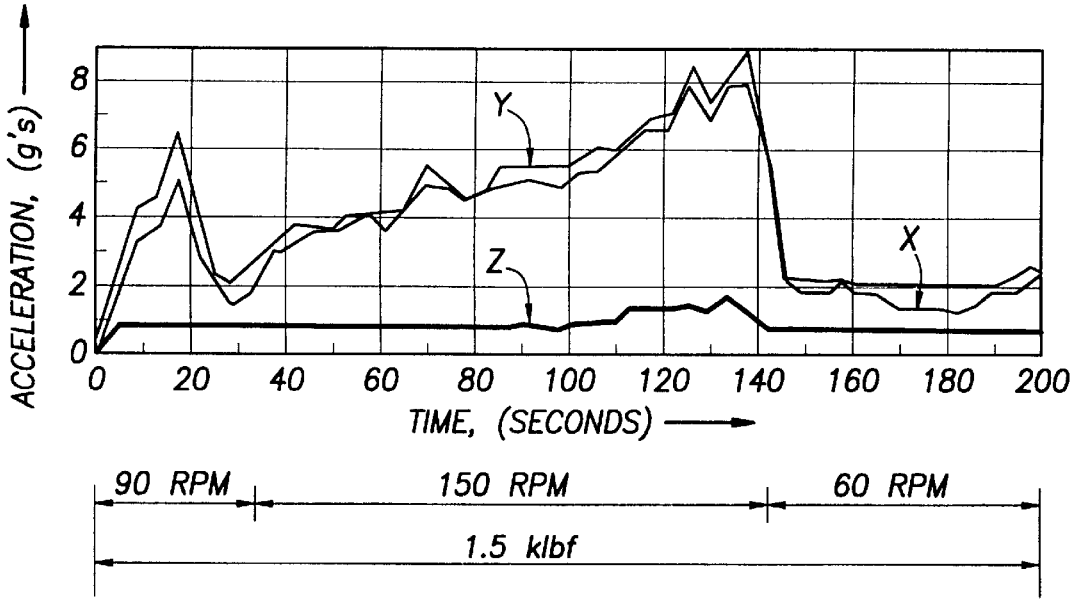

The 4-bladed conventional PDC bit was tested in the same manner as the anti-whirl bit, but FIG. 2 shows that the vibrations that it generated were much more severe. The figure contains peak and average accelerations for all three accelerometers during a test in the soft rock. Lateral (X,Y) vibrations were present even at 60 RPM, and they became severe when the rotary speed was increased to 90 and then 150 RPM, as peak and average values ultimately reached 160 g and 9 g, respectively. The large magnitudes of the peak values are typical of impacts. The intensity of the vibrations prevented higher rotary speeds from being run. The average and peak acceleration measurements paralleled one another during this and the other PDC tests, and sustained periods of high average accelerations were always associated with high peak values. The magnitudes of the X and Y accelerations were similar, although Y values were usually slightly larger. Axial (Z) accelerations were much smaller than the lateral accelerations. Although vibrations were significantly reduced when the rotary speed was decreased from 150 to 60 RPM, even at this low rotary speed lateral shocks of 40 g were measured. The same trends were observed during tests in the hard rock, but not surprisingly the magnitudes of the vibrations were worse, as lateral shocks of over 200 g were encountered.

Figure 3A:
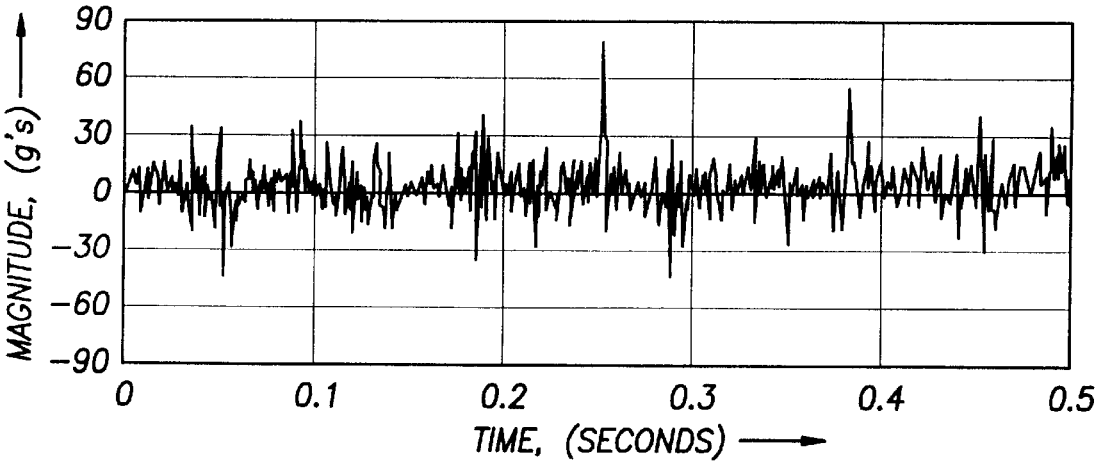
FIG. 3 represents graphs of high sampling rate acceleration data taken from a segment of the data shown in FIG. 2 with WOB equal to 1.5 klbf and RPM equal to 150.
Figure 3B:
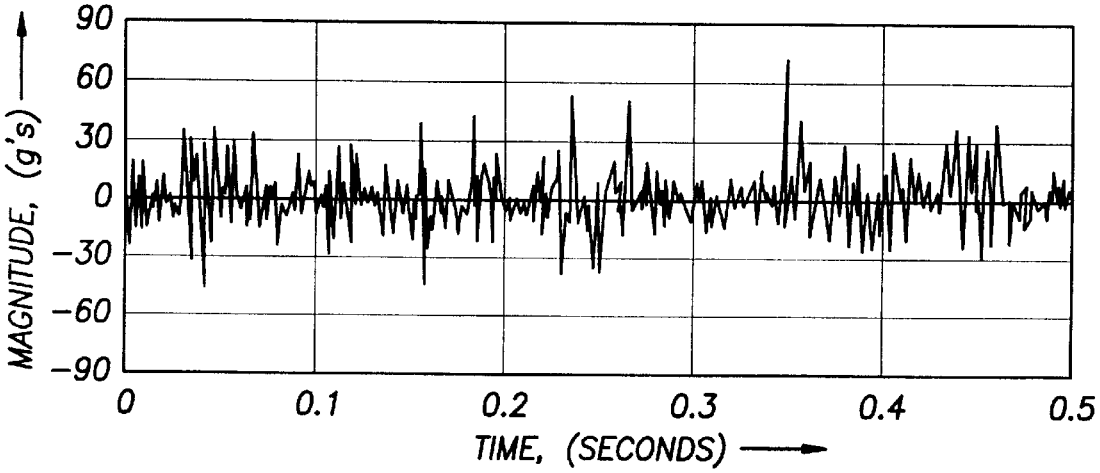
Figure 4A:
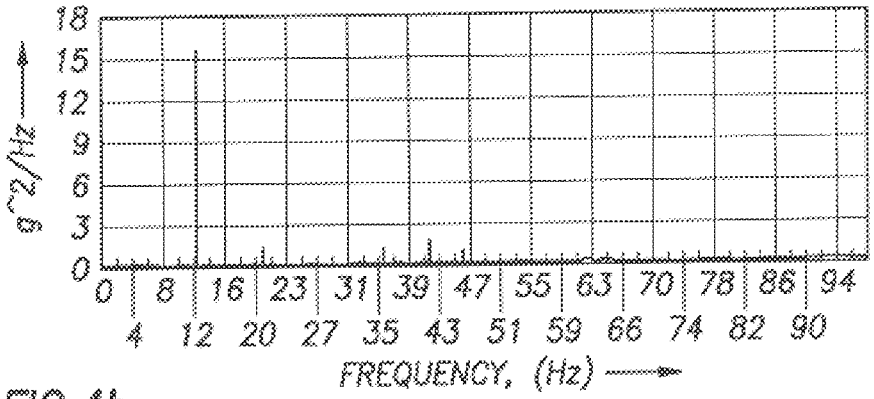
FIG. 4 illustrates the power spectra obtained from the data in FIG. 3.
Figure 4B:
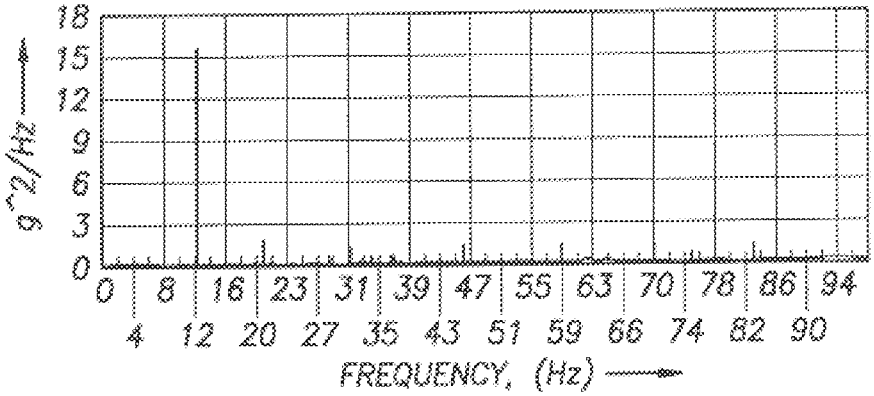

FIG. 3 shows high sampling rate DDS acceleration data from the lateral (X and Y) sensors for a portion of the test shown in FIG. 2 with 1.5 klbf WOB and 150 RPM (2.5 Hz). The spikes present in the lateral acceleration measurements resulted from impacts (shocks) between the bit and borehole wall. Severe shocks are associated with backward whirl, and are believed to be the major cause of the PDC cutter chipping and accelerated wear. FIG. 4 shows the power spectra obtained from the data in FIG. 3. The dominant peaks in both the X and Y spectra at 12.5 Hz indicate that the lateral accelerations were approximately harmonic at that frequency. Thus, the backward whirling frequency would be 12.5 Hz−2.5 Hz, equalling 10 Hz, or four times the rotary speed. As explained in more detail hereinafter, the backward whirling frequency is equal to the frequency at which the magnitude of a peak has exceeded a predetermined value minus the rotary speed of the drill bit.

The X and Y acceleration measurements can be used to determine the number of times per second that the bit walks around the hole during one revolution (the whirl frequency). Since the acceleration data were acquired on a rotating drill collar, the frequency contents will differ from those obtained from accelerations measured in a fixed reference frame.

Figure 5:
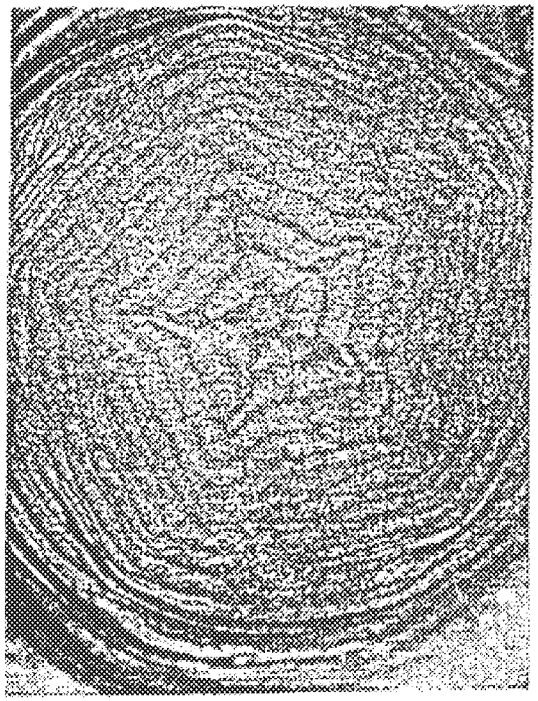
FIG. 5 illustrates a bottom hole pattern created by a conventional PDC bit in soft rock.

FIG. 5 shows the bottom hole pattern created by the 4-bladed PDC bit in the soft rock. A 5-lobed star pattern and a 1.25 in. over gauge hole are evidence that the bit was whirling backward.

Roller Cone Bit

The roller cone bit was run with the same operating conditions as the PDC bits. While this enabled direct comparisons of performance, it also resulted in most of the data being collected at rotary speeds and weights on bit more typical of motor drilling than rotary drilling.

Figure 6A:
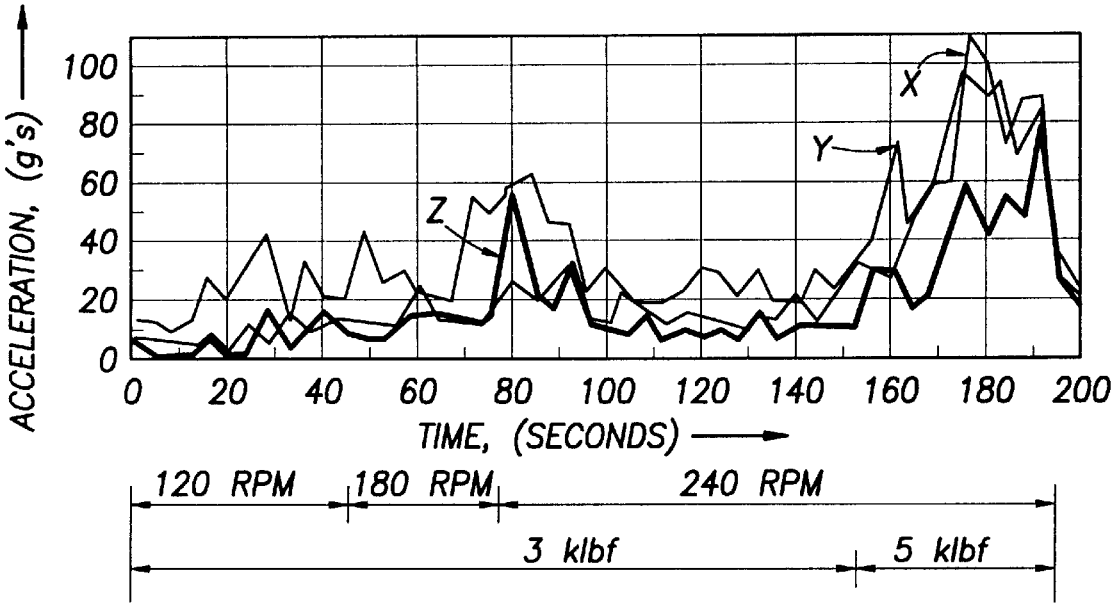
FIG. 6 represents graphs of peak and average accelerations for a roller cone bit in hard rock.
Figure 6B:
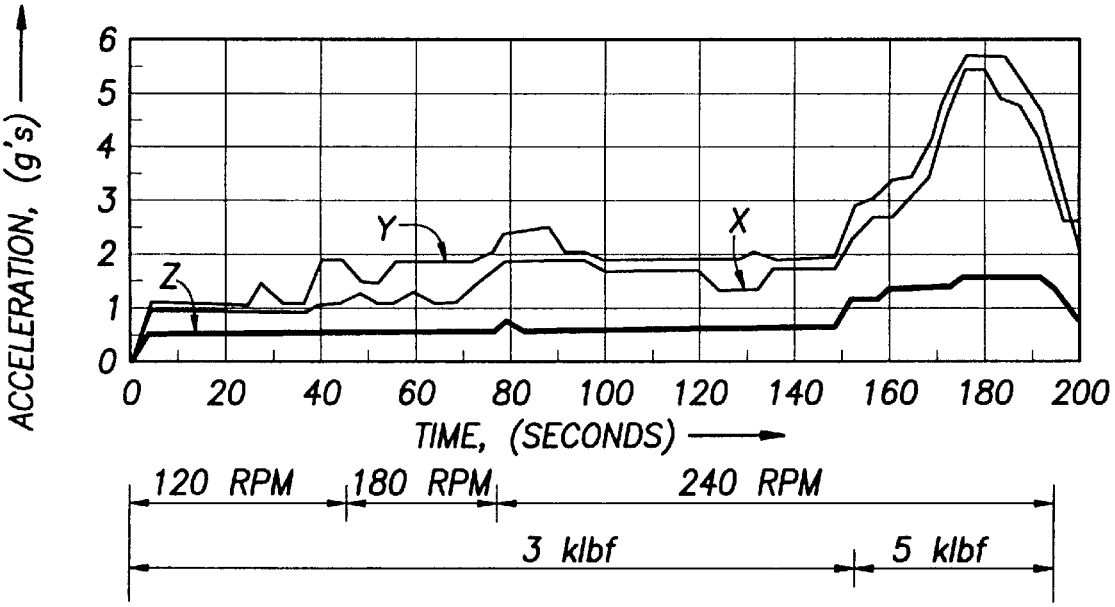

FIG. 6 shows peak and average DDS acceleration measurements for a test in the hard rock. The figure indicates that with 3 klbf WOB the bit vibrations grew in magnitude as rotary speed was increased from 120 to 180 RPM. Increasing the RPM to 240 had little effect on average accelerations, and peaks actually diminished until WOB was increased to 5 klbf. At these conditions the vibrations became very severe, as peak and average lateral (X, Y) accelerations reached levels of 100 g and 6 g, respectively. Although the axial (Z) peak data showed shocks of up to 80 g, the average axial accelerations were significantly smaller than the lateral values. Tests in the soft rock showed the same trends in behavior, but acceleration magnitudes were slightly smaller.

Measurements made following the roller cone tests showed that the bit drilled holes up to 0.5 in. over gauge. Similar results were observed for the conventional PDC bit. The two types of bits were also alike in that their axial (Z) accelerations were consistently lower than the lateral (X,Y) values. This result was initially unexpected, as roller cone bits are usually associated with axial vibrations instead of lateral vibrations. However, the axial stiffness of the laboratory drilling assembly was much larger than its lateral stiffness, and considering this, the relative magnitudes of the axial and lateral accelerations was consistent with conventional wisdom.

Figure 7A:
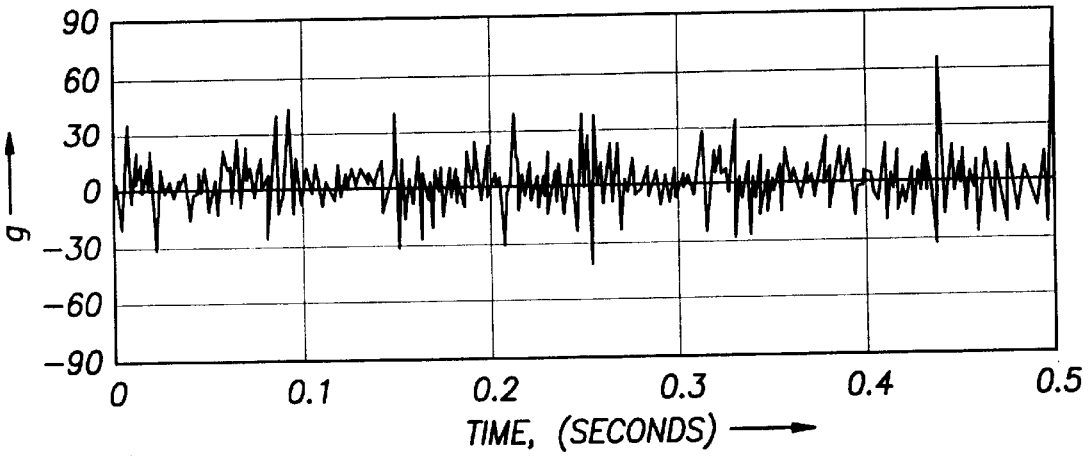
FIG. 7 represents high sampling rate measurements for a roller cone bit in hard rock at 5 klbf WOB and 240 RPM.
Figure 7B:
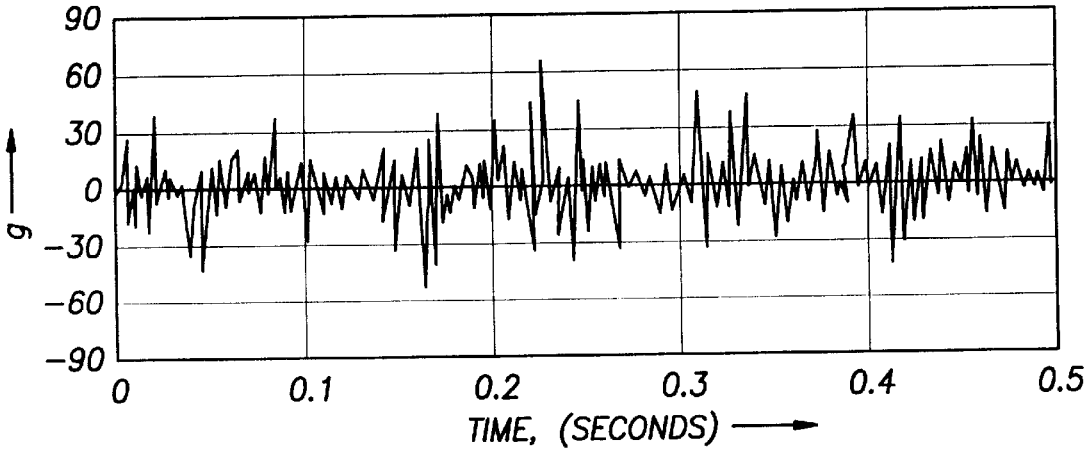
Figure 7C:
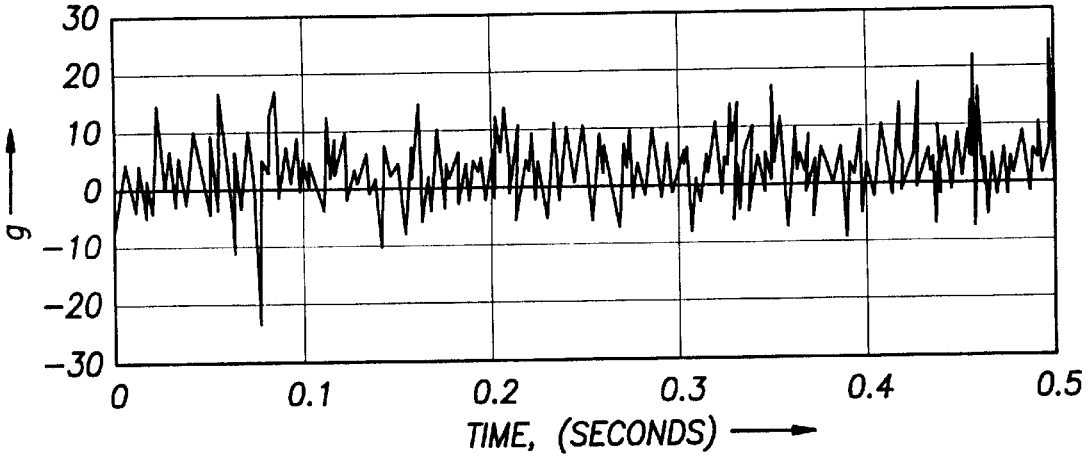
Figure 8A:
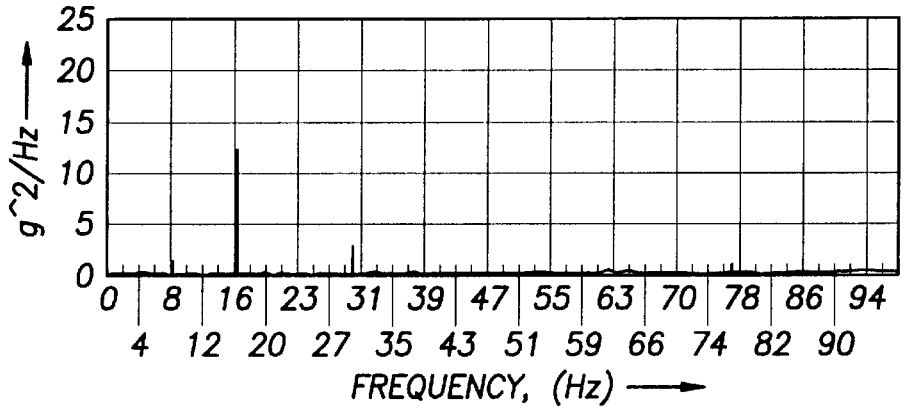
FIG. 8 illustrates the power spectra for the data illustrated in FIG. 7.
Figure 8B:
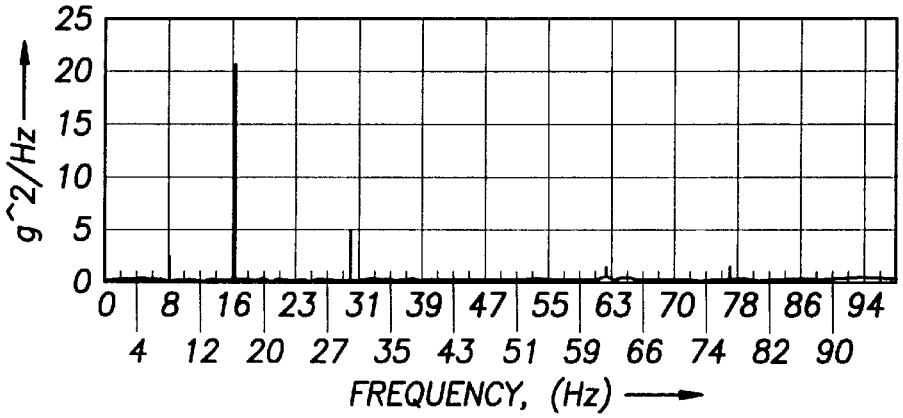
Figure 8C:
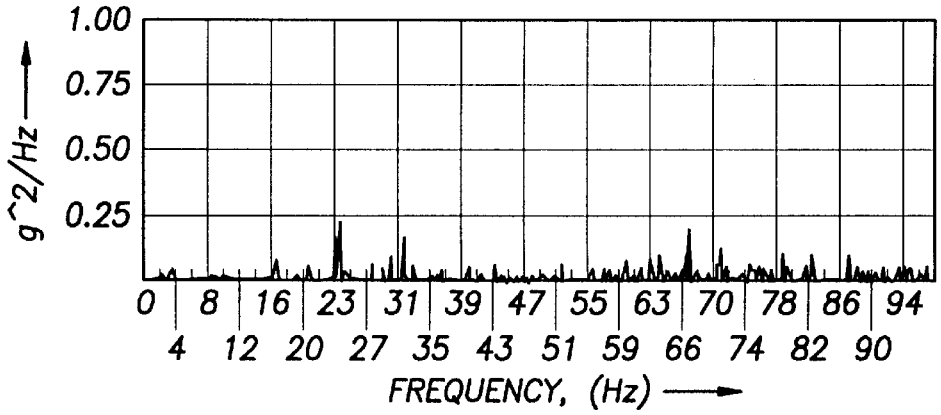

FIG. 7 shows high sampling rate DDS acceleration measurements for a portion of the test shown in FIG. 6 with 5 klbf WOB and 240 RPM (4 Hz). The mean vibration and shock magnitudes appear to be similar to those for the conventional PDC bit. FIG. 8 shows the frequency spectra for the acceleration data of FIG. 7. The dominant peaks at 16 Hz (4 times RPM) in both the X and Y accelerations imply strong, harmonic lateral vibrations. The axial (Z) acceleration contains no strong, distinct peaks and displays little coupling with the lateral motions. The frequency of backward whirling would thus be 16 Hz–4 Hz, or 12 Hz (three times the rotary speed).

Figure 9A:
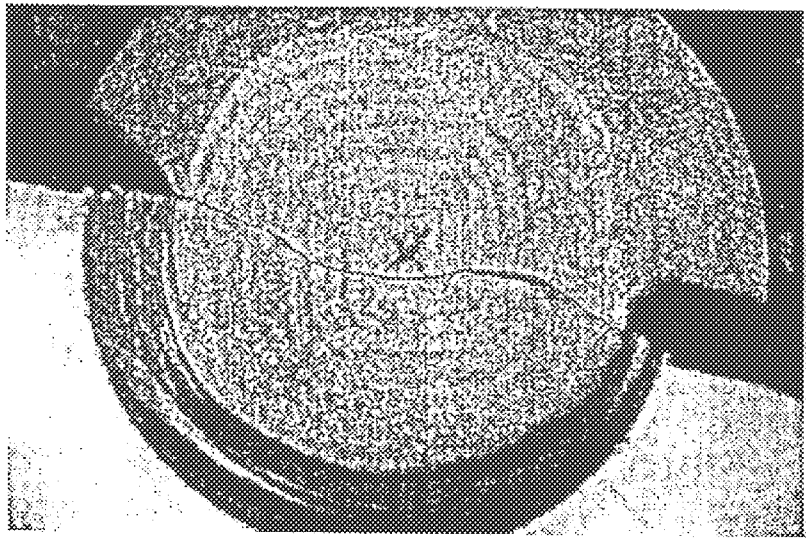
FIG. 9 illustrates bottom hole patterns obtained from roller cone bits with 3 (left) and 2 (right) cones.
Figure 9B:
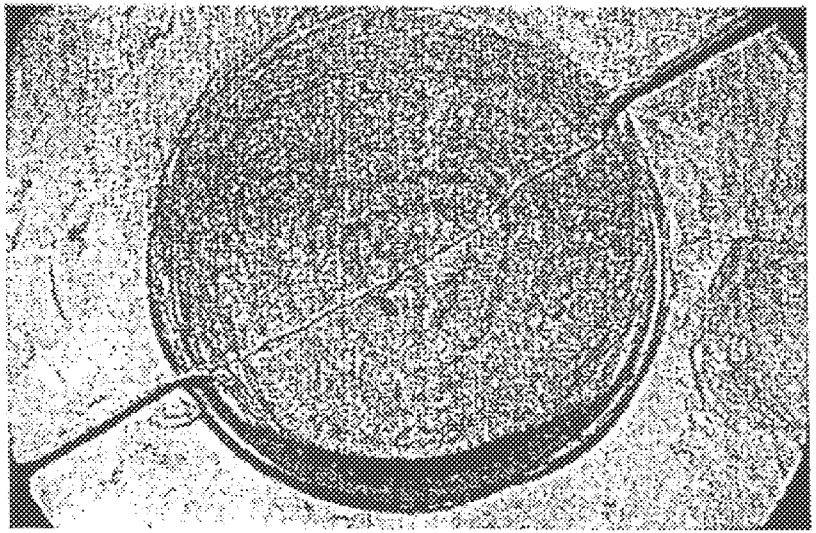

The over gauge hole and lateral vibrations can be explained by considering the design of the bit. If unconstrained, the cones on a roller cone bit would roll around a radius larger than that of the bit due to the cone profile and offset. If one cone momentarily stops, for example because of contact with the wellbore wall, the other two can still rotate for a short distance by pivoting around the stationary cone. This motion is, in effect, backward whirl; the center of rotation moves counter-clockwise from one cone to the other, and the path travelled by the center of the bit is offset from the hole center by the amount of overgauge of the borehole. If the hole is significantly over gauge, a lobed bottom hole pattern similar to those obtained for whirling PDC bits would be expected. Verification of this is provided by FIG. 9, which shows bottom hole patterns generated in the laboratory by 3- and 2-cone bits while drilling with a turbine. The operating conditions were fairly extreme, as the WOB was 17 klbf and the rotary speed was 900 RPM. The figure indicates that the 3-cone bit drilled a square hole, while the 2-cone bit drilled a triangular hole.

Figure 10:
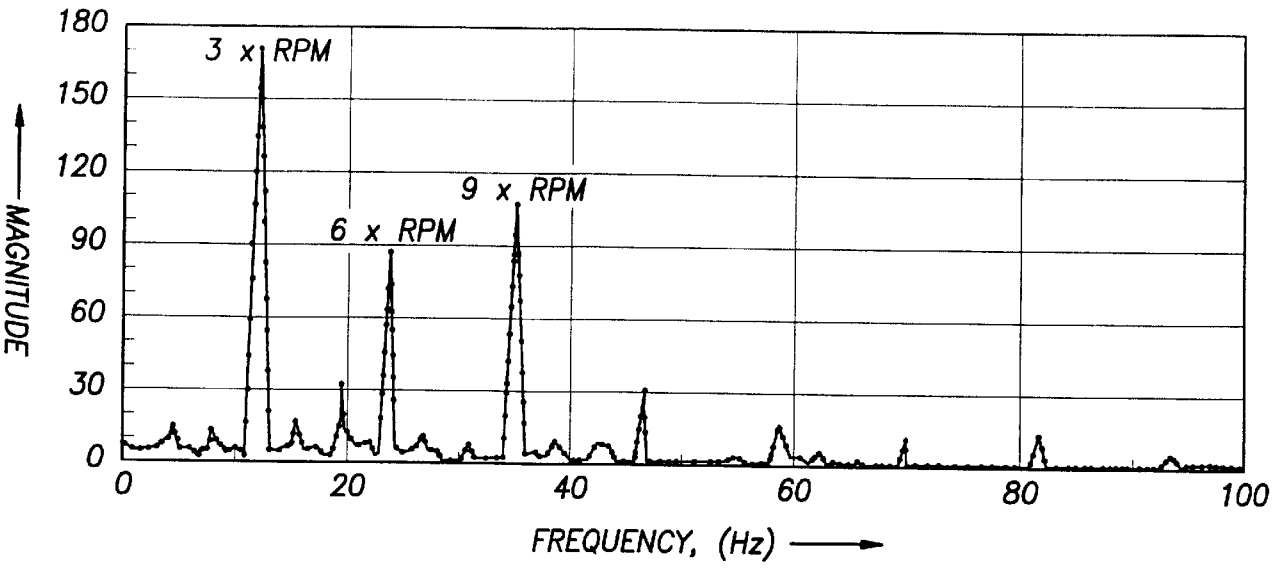
FIG. 10 illustrates the frequency content of test cell side force measurements made in the laboratory during the roller cone bit tests exemplified in FIG. 6.

If the amount of hole over gauge is small, the squareness of the hole cut by a 3-cone bit is not obvious. However, the whirling motion is still detectable from the frequency contents of accelerations or contact forces measured in rotating and fixed coordinate systems, as described in the previous section. The autospectrum of test cell side forces at the end of the test shown in FIGS. 6–8 is provided in FIG. 10. The dominant peak is at approximately 12 Hz (3 times RPM), and harmonics at 6 and 9 times RPM are present. The fact that 3 impacts occur per bit revolution suggests that the bit moved in a manner which would create a square bottom hole pattern; that is, a motion analogous to backward whirl. This is supported by the fact that the dominant frequency from the DDS measurements (rotating coordinate system) was larger than the dominant peak from the test cell force measurements (fixed system) by 4 Hz (the rotary speed). This was also the result for the conventional PDC bit when it whirled backward.

The backward whirl of roller cone bits described above was more pronounced at high rotary speeds (180 and 240 RPM) during laboratory tests. The lateral stiffness of the drilling assembly likely influenced the rotary speeds at which vibrations became severe, just as the axial stiffness is believed to have influenced axial vibrations. Some assemblies used in the field are much more flexible laterally, and for these rotary speeds at which lateral vibrations due to backward whirl become severe are in the normal operating range. This could be the cause of some of the off center wear that is commonly reported on roller cone bits. The severe impact shocks when vibrations are worst could easily break teeth on the heel rows, just as PDC cutters are chipped. Also, wear on the nozzle boss is easily explained by backward whirl in a squarish hole, but is difficult to explain otherwise.

FIELD TEST PROCEDURE

The drill string vibration experiments were performed at a commercial test facility which offered precise, automated control of surface operating conditions and high sampling rate measurements of hook load (and thus weight on bit), torque, axial acceleration, rotary speed and stand pipe pressure. Downhole measurements were obtained using the DDS sub.

The test procedure began by establishing a low WOB and rotary speed (2 klbf and 30 RPM). After 1 to 2 minutes the rotary speed was incremented, typically by 20–30 RPM, and then held for the same period of time. This continued until the maximum RPM had been reached (150–180 RPM), at which time the WOB was incremented and the process repeated. At least 3 WOB and 5 RPM were covered during each test. When a test was completed, the drill string was pulled out of the hole and the DDS sensor was repositioned. The sub was used to monitor vibrations at several locations in the drill string for each type of bit.

The tests were performed between 470 and 700 ft. in formations which ranged from sands to shales, but had fairly constant strengths of co=5,000 psi. The drill string consisted of 6.25 in. drill collars with full gauge integral blade stabilizers at approximately 60 and 90 feet above the bit. Drill collars were run to surface to minimize torsional oscillations due to stick-slip, which in turn simplified interpretation of both downhole and surface measurements. The bits used were the same type as those tested in the laboratory, all as discussed above.

FIELD TEST RESULTS

Conventional PDC Bit

FIGS. 11*a–e* show surface and downhole measurements for a typical experiment with the conventional PDC bit. The lowermost figure shows the peak accelerations measured by the DDS. The sub was placed near the bit. The rotary speed, weight on bit, swivel axial acceleration, and surface torque are shown in the figures above the peak downhole accelerations. The rotary speed can be seen to increase in a step-wise manner, with three weights on bit (2, 5, and 8 klbf). The 200 second gap present in the figures corresponded to the making of a connection.

At 2 klbf the peak accelerations were fairly constant at 3, 12 and 9 g over the range of 30 to 180 RPM for the X, Y and Z gauges, respectively. The Y gauge consistently recorded larger accelerations than the X gauge, which implied that tangential accelerations (which only affect the Y gauge) were superimposed over lateral bit vibrations (which affect both X and Y). The relatively large axial (Z) accelerations were somewhat surprising for this bit, as they were not observed in the laboratory. This likely resulted from coupling between lateral and axial vibrations in the relatively limber pendulum portion of the assembly, and is an important consideration for bit and BHA design. When WOB increased to 5 klbf each of the accelerations increased slightly. Unlike the 2 klbf case, at this weight the accelerations increased roughly linearly with RPM to levels of 6, 19, and 12 g for X, Y, and Z. After the connection the WOB was set at 10 klbf, and again the levels of accelerations increased. This was in contrast to laboratory data, which suggested that higher WOB would reduce vibrations for conventional (and anti-whirl) PDC bits. As RPM increased the lateral (X and Y) accelerations grew from 10 to 15 and 25 to 40 g, while the Z accelerations held at 14 g. The ROP also increased, until at 180 RPM less than 5 klbf could be held on the bit.

Figure 11A:
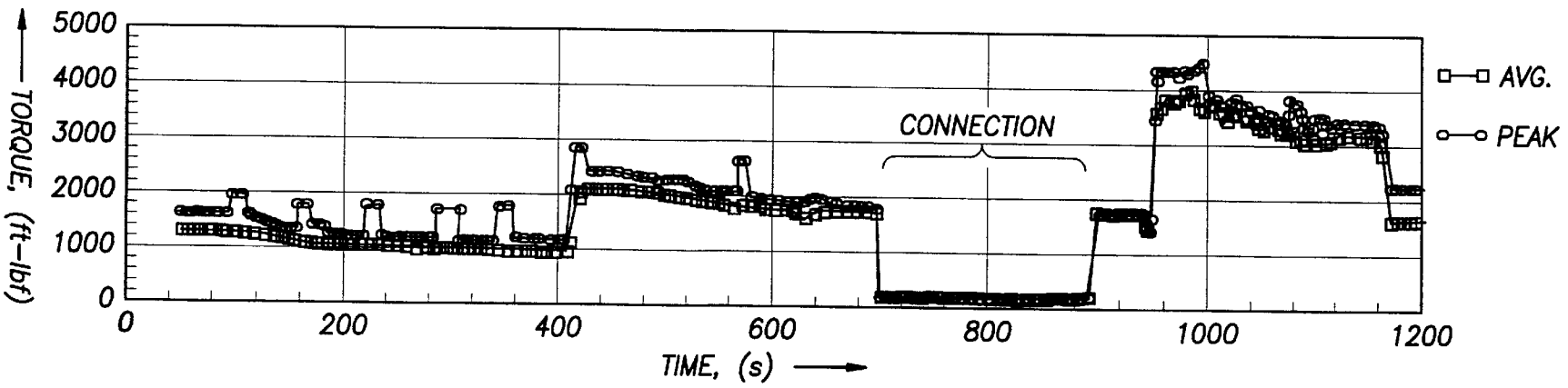
FIG. 11*a* graphically illustrates surface torque versus time, as WOB and RPM were varied.

The surface torque trends shown in FIG. 11*a* were consistent with laboratory measurements in that torque increased with WOB, and at a given WOB decreased as RPM increased. Occasional torsional oscillations were observed at low WOB when the RPM was abruptly changed. The oscillations are indicated by divergence of peak and average torque values in the figure, and resulted from the strong coupling between WOB and torque for these bits. Their amplitudes diminished as rotary speed was increased. Comparison with FIG. 11*e* suggests that neither peak nor average torque values were good indicators of bit vibration severity; this result was consistent for all conventional PDC bit tests.

Figure 11B:
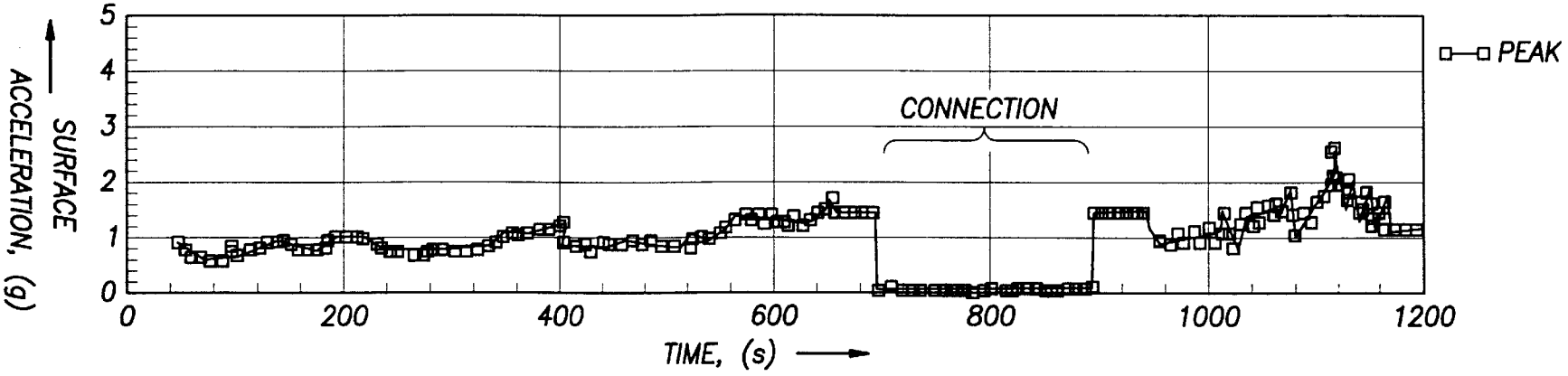
FIG. 11*b* graphically illustrates surface acceleration versus time, as WOB and RPM were varied.
Figure 11C:
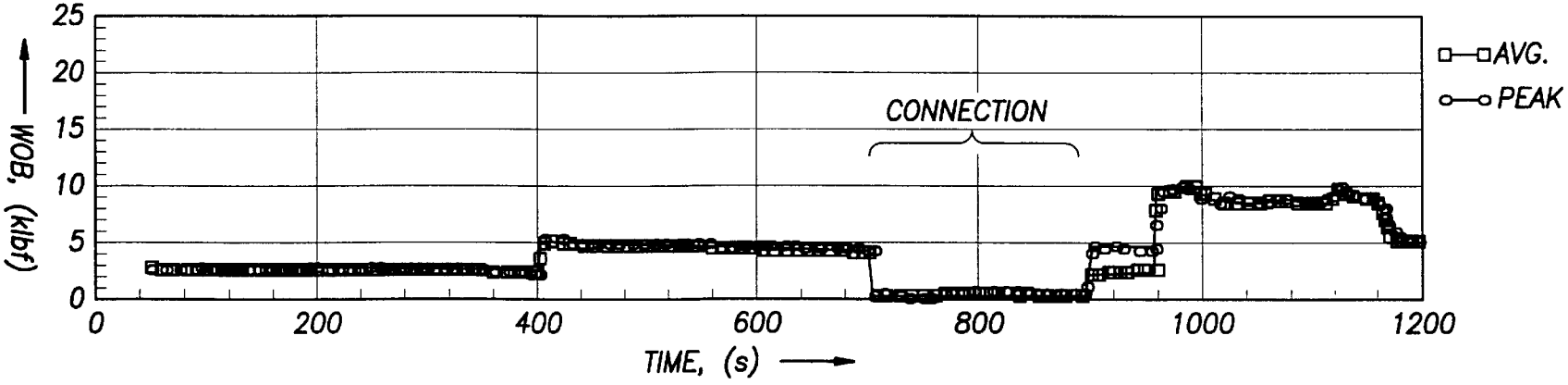
FIG. 11*c* graphically illustrates WOB versus time for three values of WOB.
Figure 11D:
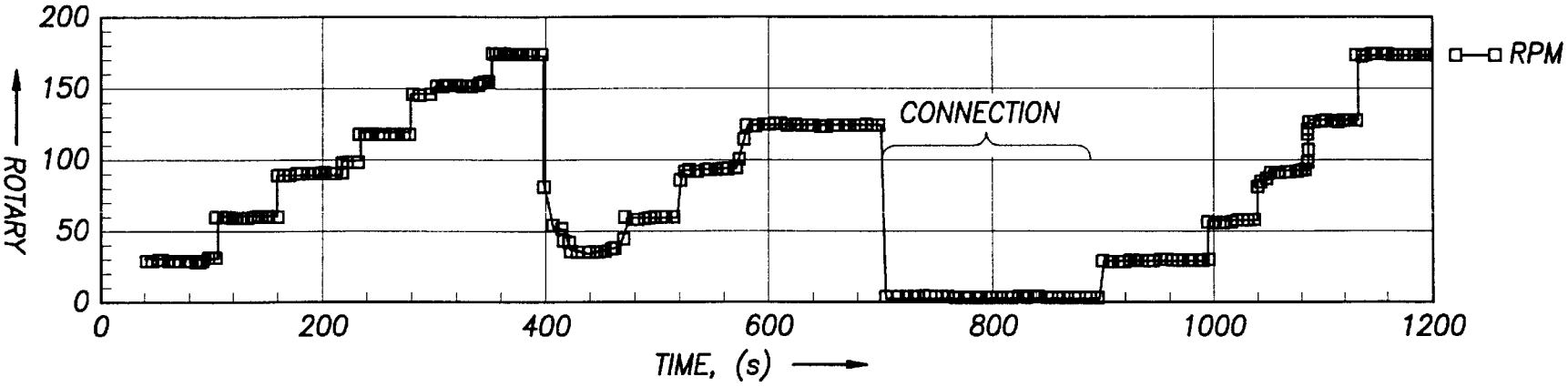
FIG. 11*d* graphically illustrates rotary speed versus time for various values of WOB.
Figure 11E:
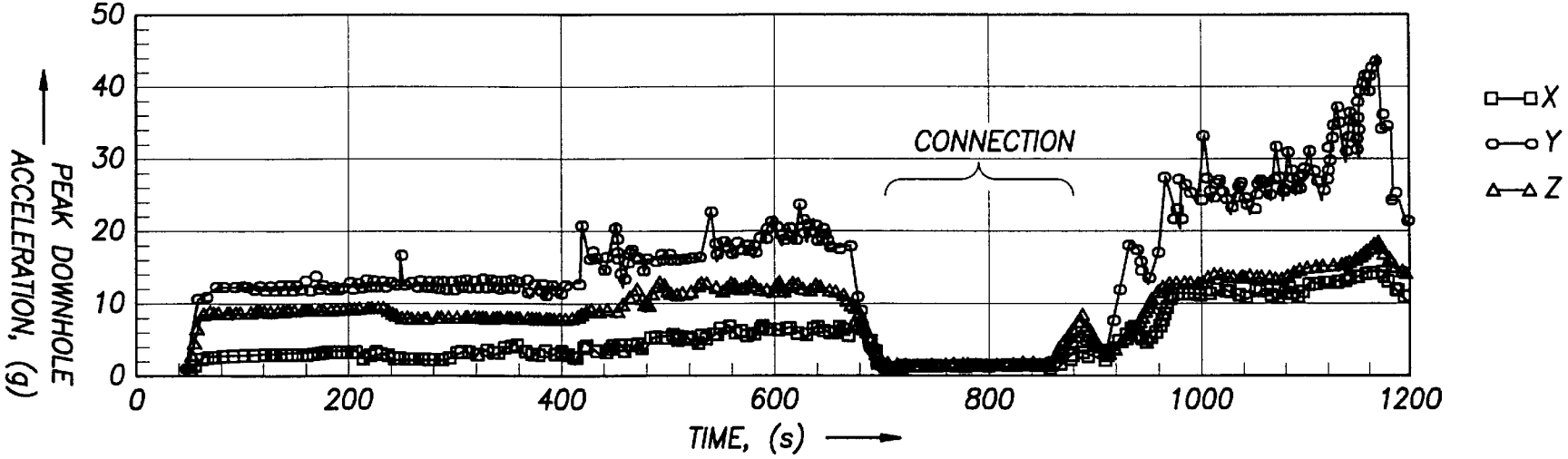
FIG. 11*e* graphically illustrates peak downhole acceleration versus time during the testing of a conventional PDC bit, using near-bit sensors.

FIG. 11*b* shows that the axial accelerations at the power swivel were steady and of low magnitude at low WOB and RPM. As RPM increased the magnitude of the accelerations gradually increased. The vibration levels at a given RPM also increased roughly linearly with WOB. Comparison with FIG. 11*e* shows that although the magnitudes of surface axial accelerations were much smaller, their trend paralleled those of downhole axial and lateral accelerations quite well. Presumably this was due to the strong coupling between lateral and axial accelerations for this bit in this assembly.

Figure 12A:
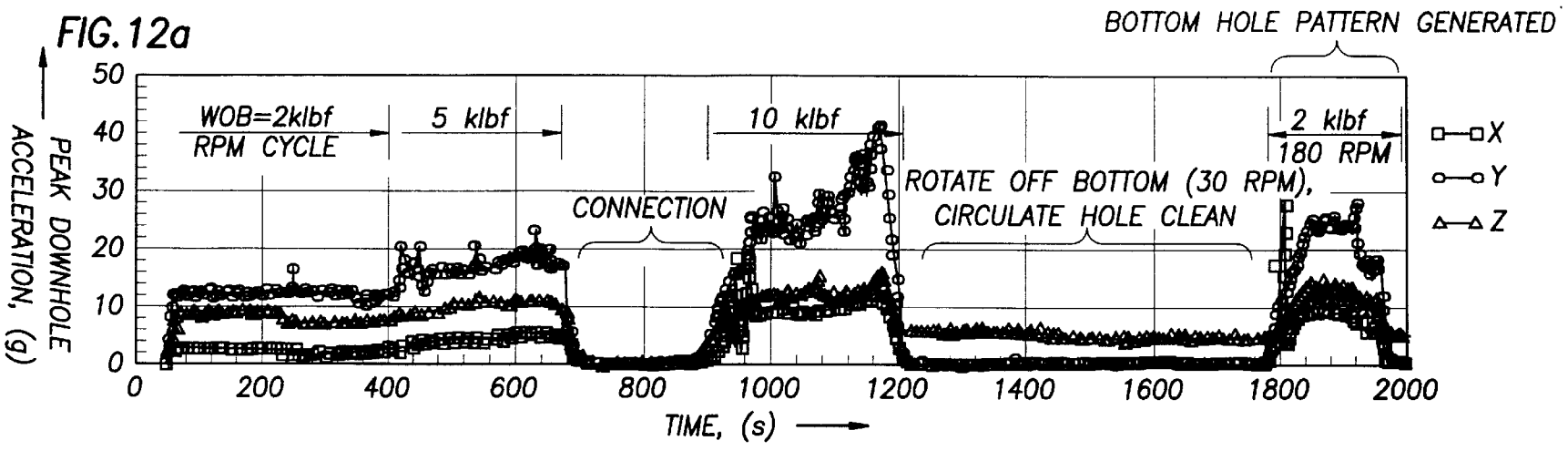
FIG. 12*a* graphically illustrates peak downhole acceleration versus time for a conventional PDC bit, using near-bit sensors, but with the RPM for a given WOB being cycled as in FIG. 11*b;*
Figure 12B:
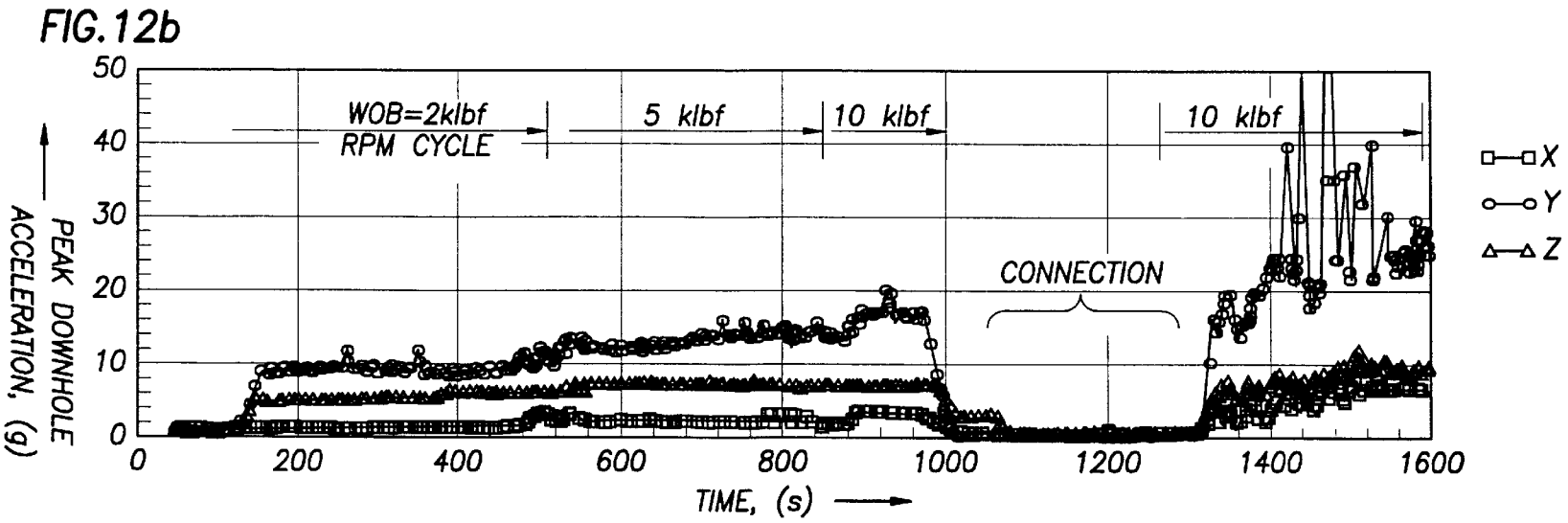
FIG. 12*b* graphically illustrates peak downhole acceleration versus time for a conventional PDC bit, but having the sensors placed one drill collar away from the bit.

FIGS. 12*a–d* show downhole accelerations measured during 4 PDC bit tests which were similar but for the placement of the DDS tool. Comparison of FIGS. 12*a* and 12*b* shows a 50% reduction in amplitude for the X peaks when the DDS sub was moved from the bit to midway between the bit and the lowermost stabilizer, while the Y and Z peaks were reduced by a smaller amount. The reduction in the X accelerations suggest that the pendulum portion of the assembly behaved as a cantilever, while the stabilized portion acted built-in. For this case the lateral displacements, velocities and accelerations decrease linearly with distance from the bit. The Y accelerations were not affected to the same extent because they are also sensitive to tangential accelerations, as mentioned previously. Comparison of FIGS. 12*b* and 12*c* suggests that a stabilizer between the bit and measurement sub significantly reduces amplitudes measured for lateral and axial accelerations. The remaining figures show continued reduction in amplitudes with distance from the bit. If the intent in the field is to measure bit vibrations, then these results suggest that the sub be placed as close to the bit as possible, and no stabilizers should separate sensor and bit. Conversely, if an MWD tool is to be protected from harmful vibrations, then full gauge stabilizers provide some degree of isolation.

Figure 12C:
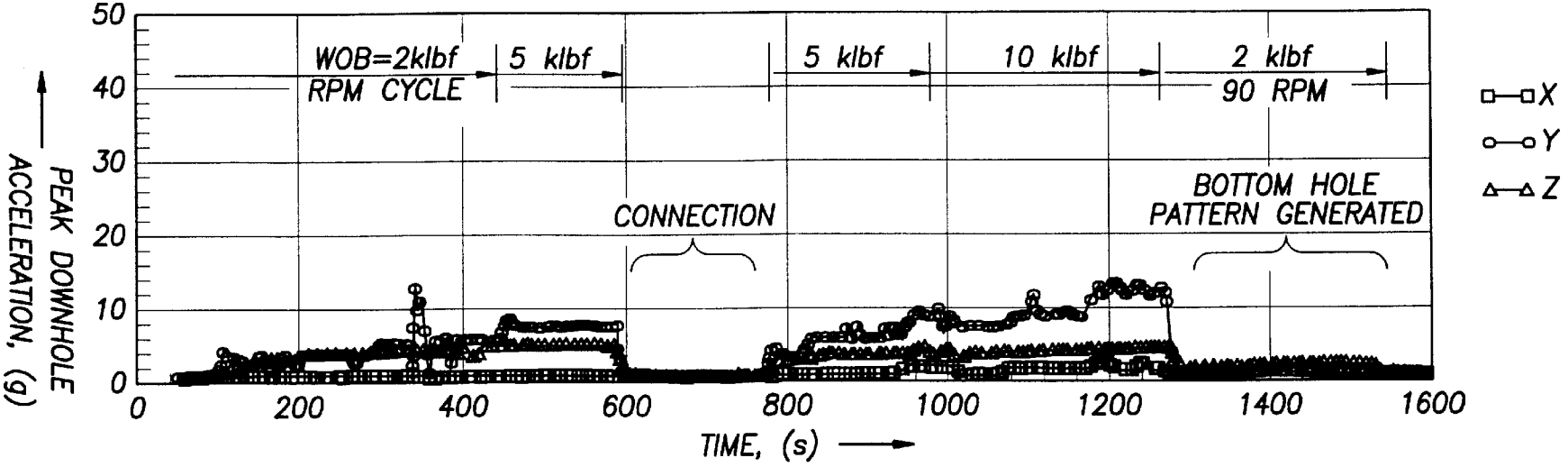
FIG. 12*c* graphically illustrates peak downhole acceleration versus time, but having the sensors placed between stabilizers in the drillstring.
Figure 12D:
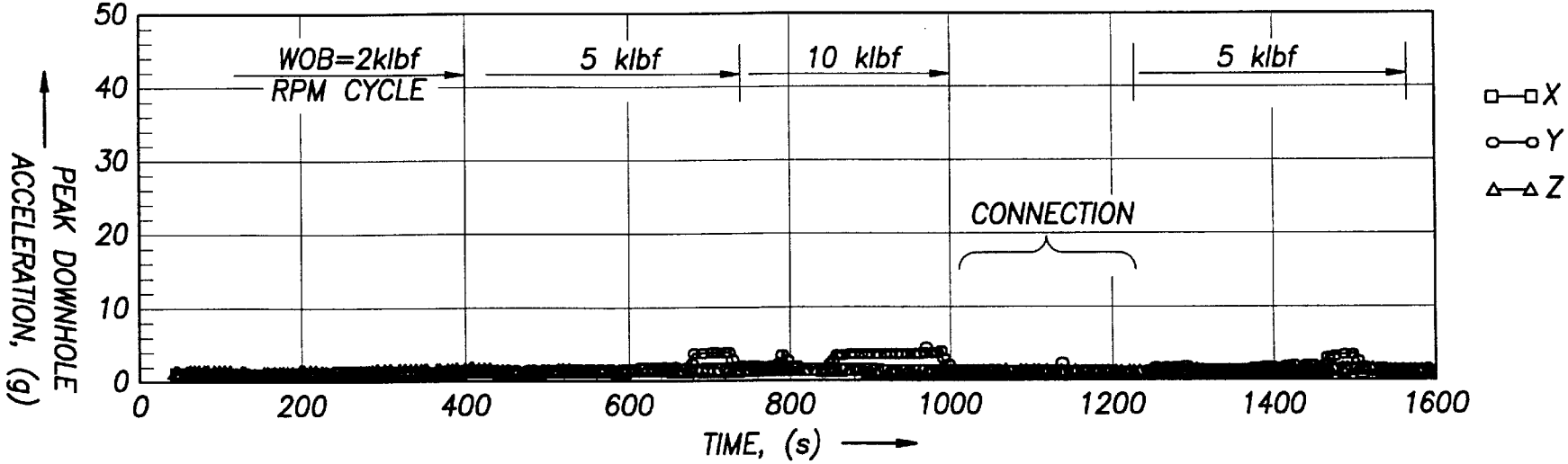
FIG. 12*d* graphically illustrates peak downhole acceleration versus time as the sensors are moved even closer to the earth's surface.

It is interesting to compare the axial (Z) accelerations measured above the uppermost stabilizer in FIG. 12*d* with the surface acceleration measurements shown in FIG. 11*b*. For the same operating conditions, the magnitudes are very similar. This should be expected, as the drill string is short and consists of only one component geometry. For drill strings of typical length, and different bottom hole assemblies, the axial acceleration measured at the surface may not reflect the bit vibration as well as in these tests.

Figure 13:
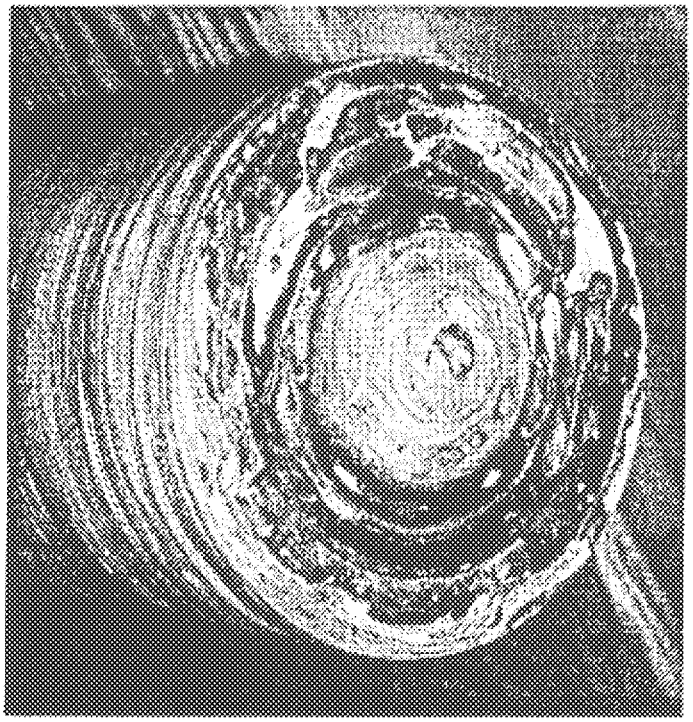
FIG. 13 illustrates a bottom hole pattern associated with the data of FIG. 12*c;*
Figure 14:
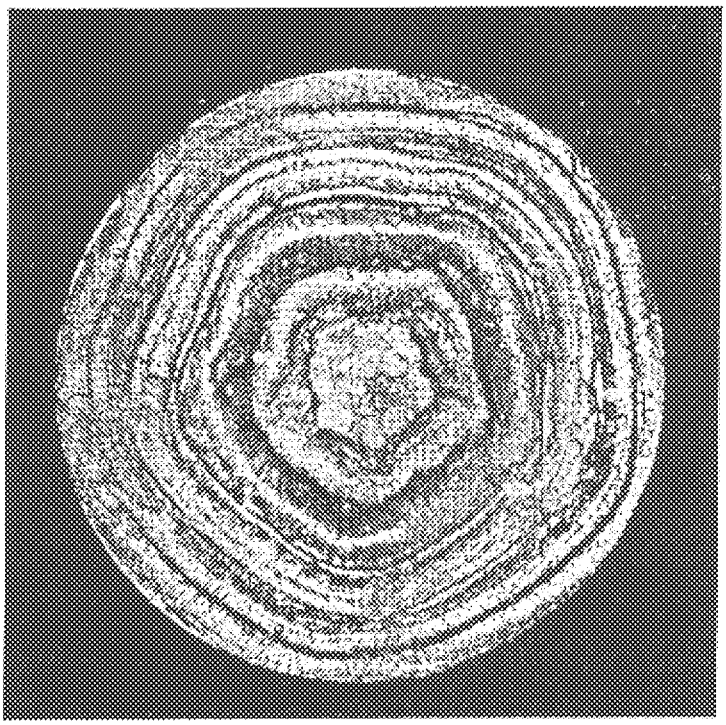
FIG. 14 illustrates a bottom hole pattern associated with the data of FIG. 12*a;*

At the conclusion of two of the PDC tests (FIGS. 12*a* and 12*c*) the bottom hole patterns were retrieved using a special coring device. For the first core (DDS between stabilizers) the RPM was set at 90 and the WOB at 2 klbf to duplicate conditions at which backward whirl was observed in the laboratory. FIG. 13 shows the bottom hole pattern retrieved; the concentric circles indicated a smooth running bit. The downhole accelerations measured verified this, as the peak values were 1 g for X and Y, and 2–3 g for Z when the pattern was created. Interestingly enough, the sensor suggested that the bit was whirling during the test, but not when the pattern was created. For the second core (DDS above bit) the conditions were set at 180 RPM and 2 klbf WOB. FIG. 14 shows that for these conditions the bit was clearly whirling backwards, as a 5-lobed pattern was obtained. The peak downhole accelerations while the pattern was generated were 10 g, 25 g, and 13 g for X, Y, and Z, respectively. These values were smaller than those observed in the laboratory for the same operating conditions because the formation drilled was much softer.

Figure 15A:
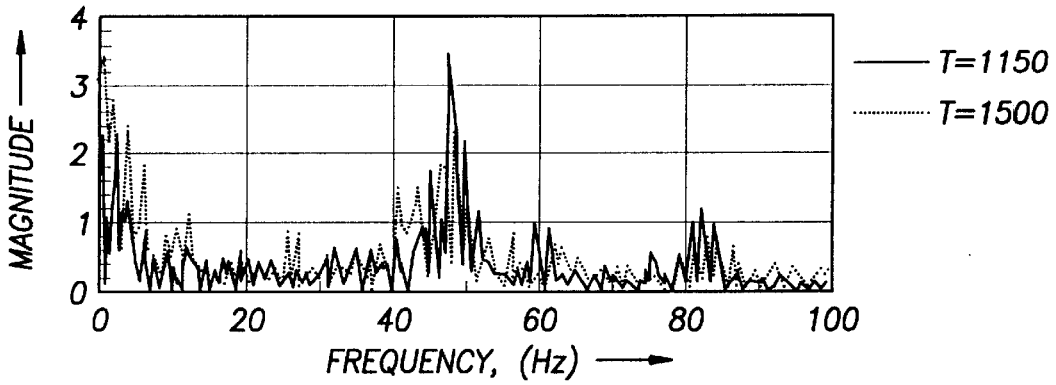
FIG. 15 graphically illustrates surface vibrations (magnitude versus frequency) associated with the data illustrated in FIG. 12*c;*
Figure 15B:
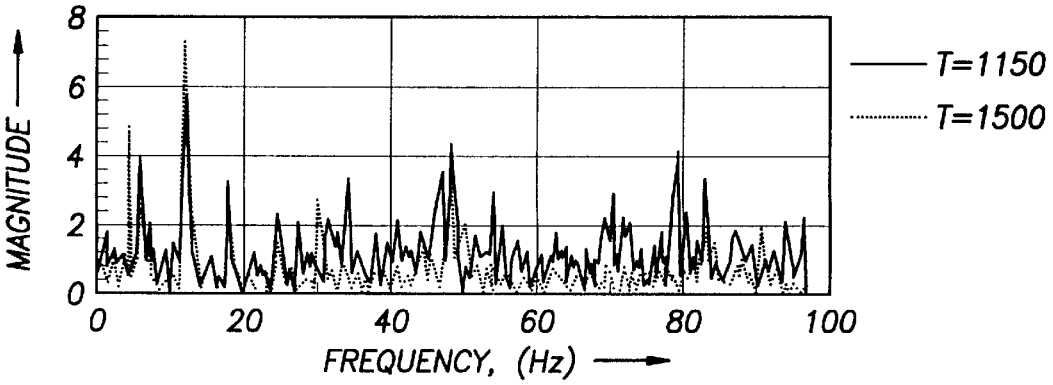
Figure 15C:
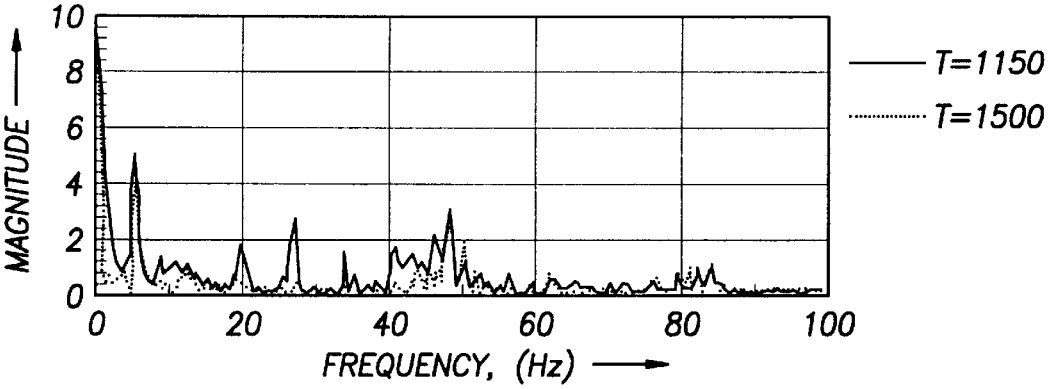

FIG. 15 presents the spectral contents of WOB, torque and axial acceleration measured at the surface during the test shown in FIG. 12*c*. Two spectra are superposed in each figure. The first was obtained at time=1150 for 90 RPM and 7 klbf WOB, and at these conditions downhole measurements suggested that the bit was whirling. The second trace was obtained at time=1500 with 90 RPM and 2 klbf WOB, and both downhole measurements and the bottom hole pattern suggested smooth drilling in this instance. Comparing the spectral contents, no obvious bit whirl signature is present. This suggests that only downhole measurements are capable of detecting a whirling bit, which is consistent with the observations of those in this art.

Roller Cone Bit

Figure 16A:
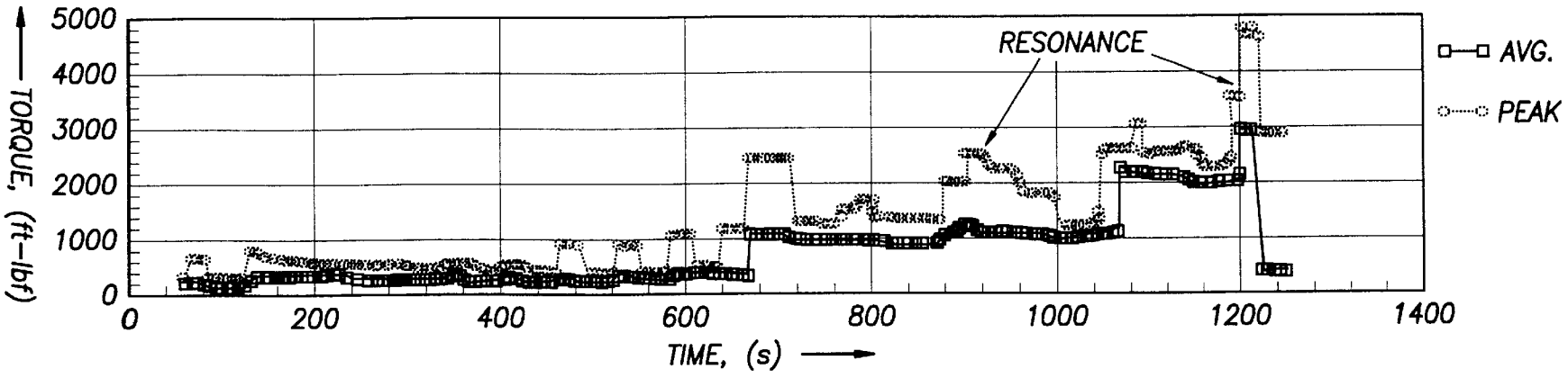
FIG. 16*a* illustrates mean surface torque versus time in testing a roller cone bit with variations in WOB and RPM, with the sensors placed near the bit.

FIGS. 16*a–e* show surface and downhole measurements for a typical experiment with the roller cone bit. FIG. 16*e* contains peak accelerations obtained from the DDS when the sensor was placed near the bit. Rotary speed, weight on bit, swivel axial acceleration, and surface torque are shown in the accompanying figures.

FIG. 16*e* suggests that the vibrations generated by the roller cone bit were much less severe than those of the conventional PDC bit. No shocks were measured at 2 klbf WOB until 75 to 90 RPM, when 3 to 5 g X values appeared. At 120 RPM no shocks were indicated, but at 150 RPM the small X shocks resumed. At 180 RPM X peaks reached 16 g. When the WOB was rapidly increased to 10 klbf the DDS measured 18 g axial (Z) accelerations, but these quickly subsided. At 60 RPM 5 g axial peaks were indicated, and at 75 RPM 3 g Z and X peaks were measured downhole, while severe surface vibrations were encountered. A sudden drop in rotary speed from 120 to 30 RPM generated a 10 g Y peak. At 20 klbf WOB small Z peaks were measured at 60 RPM. At 90 RPM these increased, but remained very small at only 2 g, despite the fact the vibrations at the surface were severe. The relatively small magnitudes of accelerations downhole were not surprising, given that a hard formation roller cone bit was drilling soft formations over the test interval. The lack of an obvious trend in bit vibration with WOB and RPM suggested that vibrations that were measured resulted more from the drill string than the bit.

FIGS. 17*a–e* provide further evidence of this. The figures contain downhole accelerations measured when the sensor was placed at various locations in the assembly. When placed in the pendulum the first lateral shocks were measured at 75 to 90 RPM. These values are consistent with the first mode of flexural vibration of the span of drill collars between the bit and the lowermost stabilizer. When placed between the two stabilizers, the DDS recorded lateral shocks only at or above 150 RPM; again, this result is consistent with the first mode of the span of collars between the two stabilizers. When placed one collar above the uppermost stabilizer shocks were measured at 150 RPM, and 2 collars above this point very little was measured, regardless of rotary speed. Finally, at 6 collars above the uppermost stabilizer lateral shocks appeared at 120 RPM. The close correspondence between natural frequencies of lateral vibration for the stabilized portion of the assembly and occurrence of lateral shocks suggested that the accelerations measured downhole resulted from drill string excitations, as opposed to the bit. Mass imbalance or out of straightness of the drill collars was the likely source of these excitations. It can be noted that peak X values were larger than Y values for all of these tests, a result much different from the conventional PDC tests. Apparently the impacts were aligned with the X gauge.

Because the lateral vibrations measured at various locations in the assembly were generated by the drill collars, reduction in amplitude with distance from the bit was not obvious. Axial (Z) peaks measured downhole were observed to diminish with distance from the bit, which suggests that they were, in fact, bit driven.

Figure 16B:
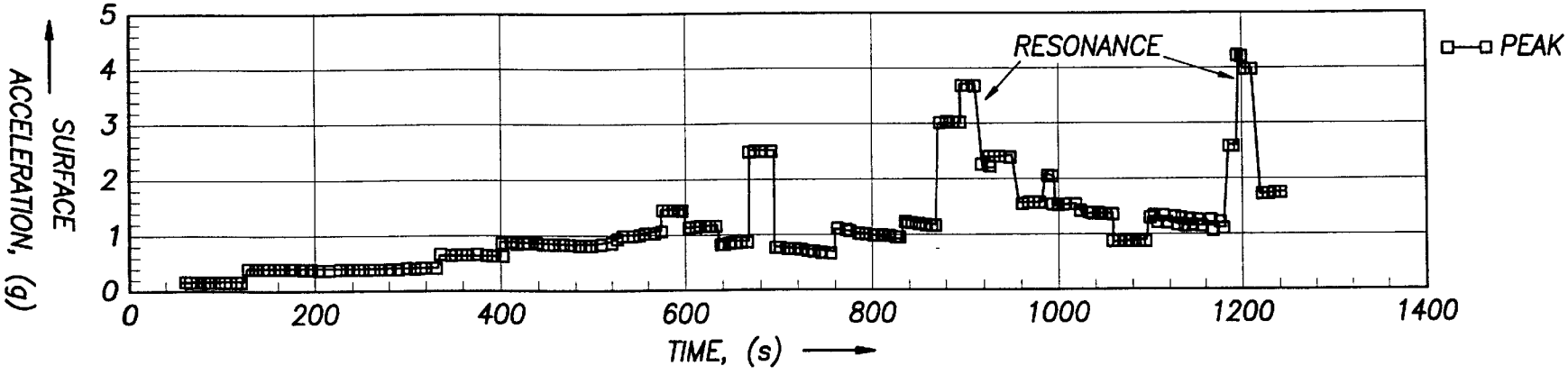
FIG. 16*c* illustrates WOB versus time, in testing a roller cone bit, with the sensors placed near the bit.
FIG. 16*d* illustrates rotary speed versus time, in testing a roller cone bit, with the sensors placed near the bit.
FIG. 16*e* illustrates peak downhole acceleration versus time, in testing a roller cone bit, with the sensors placed near the bit.
Figure 16C:
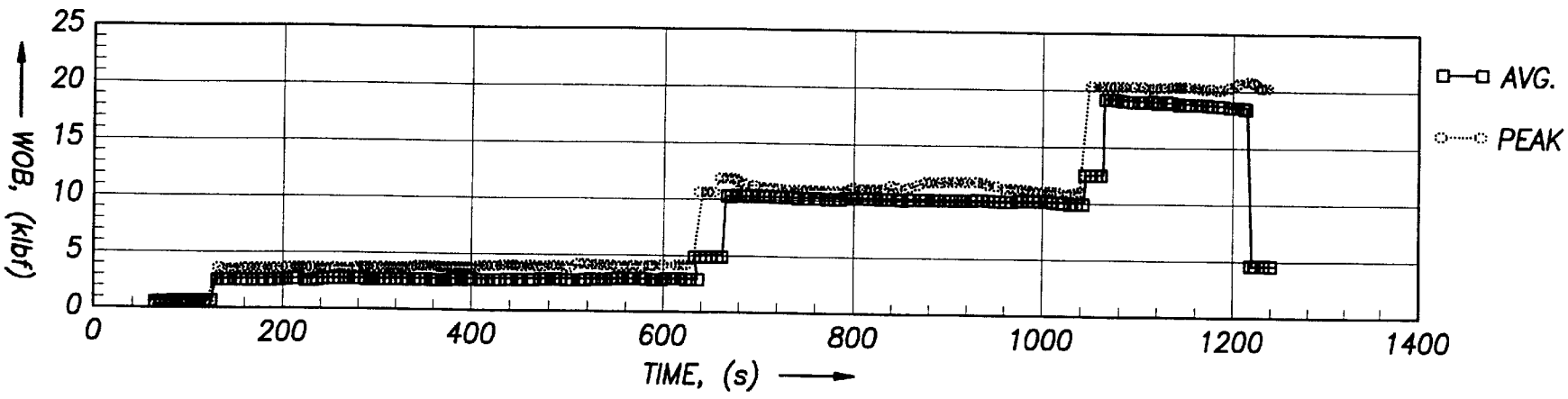
Figure 16D:
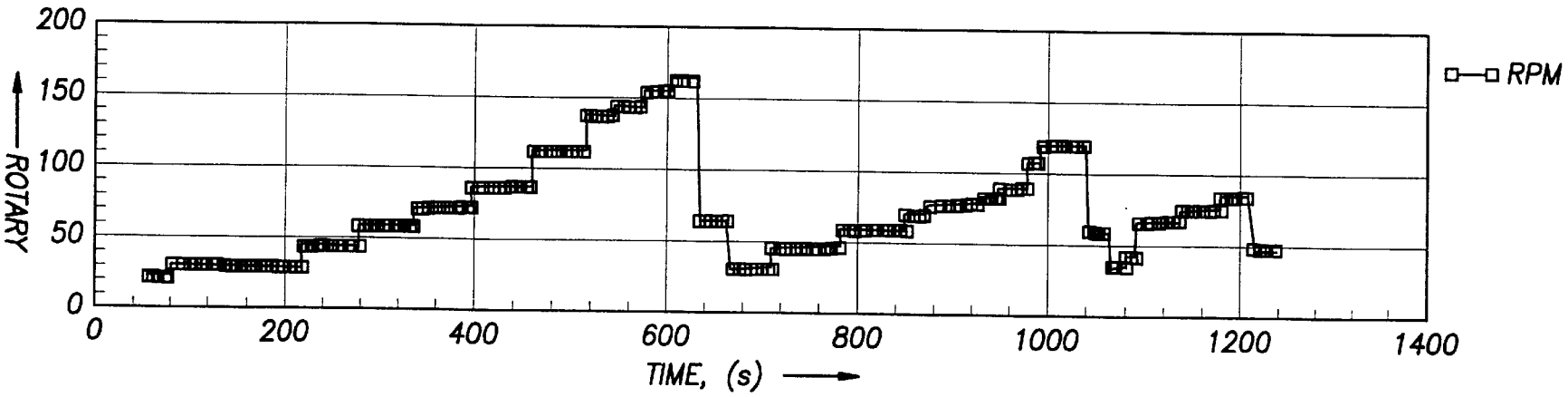
Figure 17A:
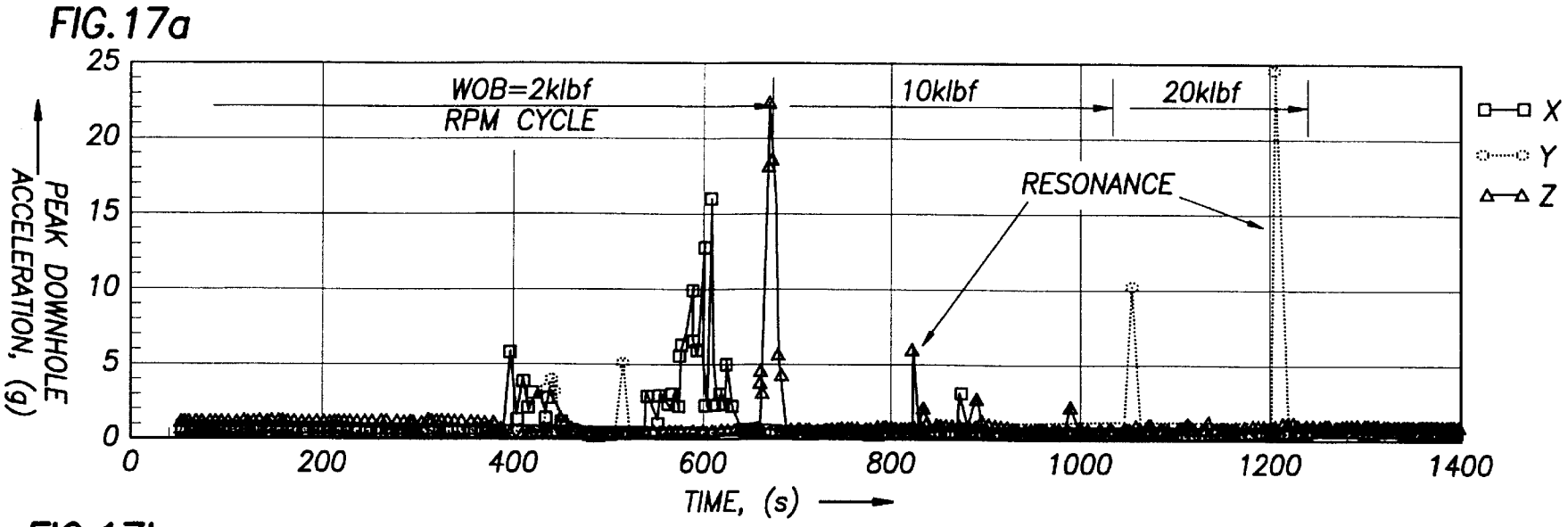
FIG. 17*a* illustrates peak acceleration versus time for a roller cone bit, with the sensors placed near the bit.
Figure 17B:
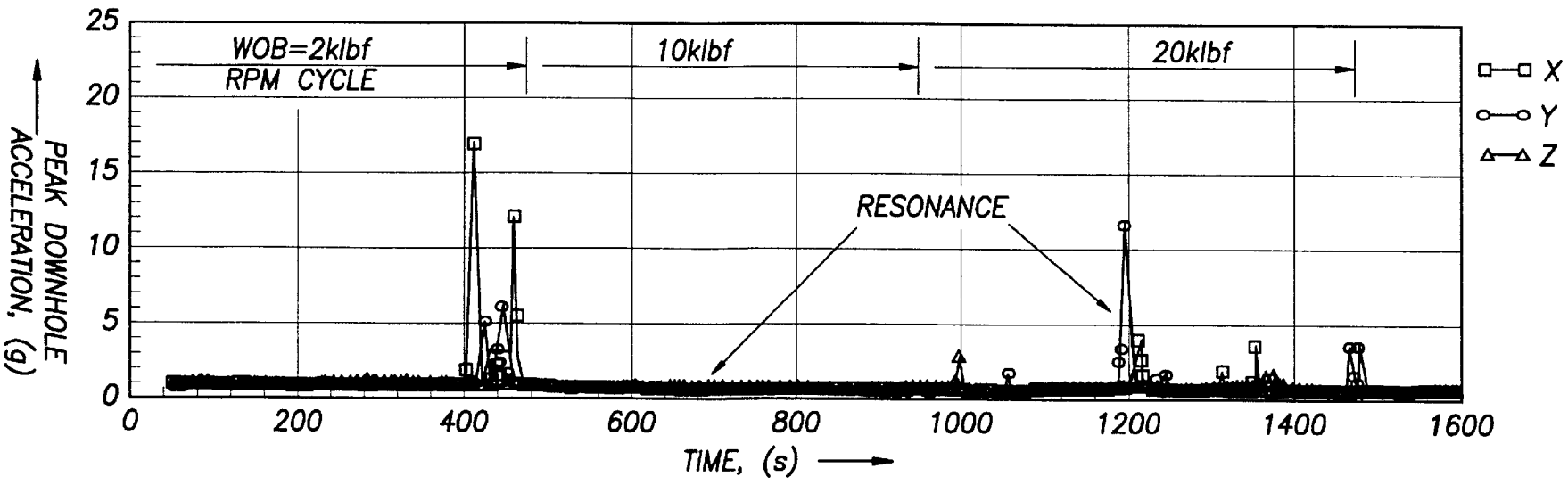
FIG. 17*b* illustrates peak acceleration versus time for a roller cone bit with the sensors placed between two stabilizers.
Figure 17C:
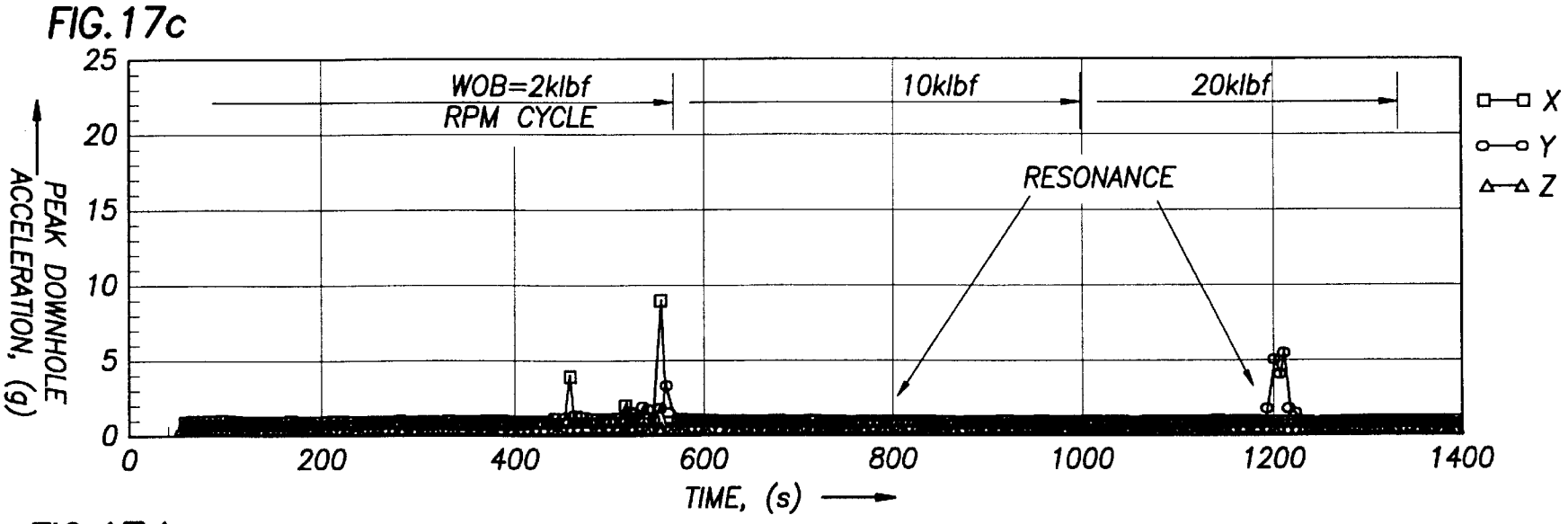
FIG. 17*c* illustrates peak acceleration versus time for a roller cone bit with the sensors placed even closer to the earth's surface.
Figure 17D:
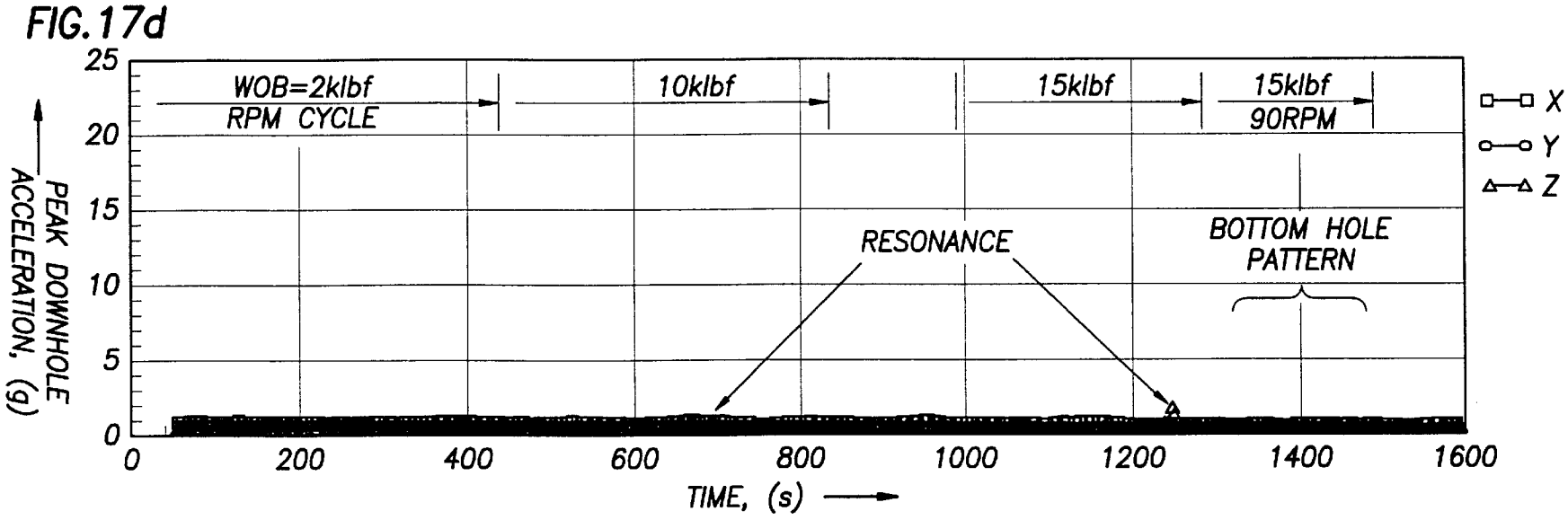
FIG. 17*d* illustrates peak acceleration versus time for a roller cone bit with the sensors placed even closer to the earth's surface than the placements for the data of FIG. 17*c;*
Figure 17E:
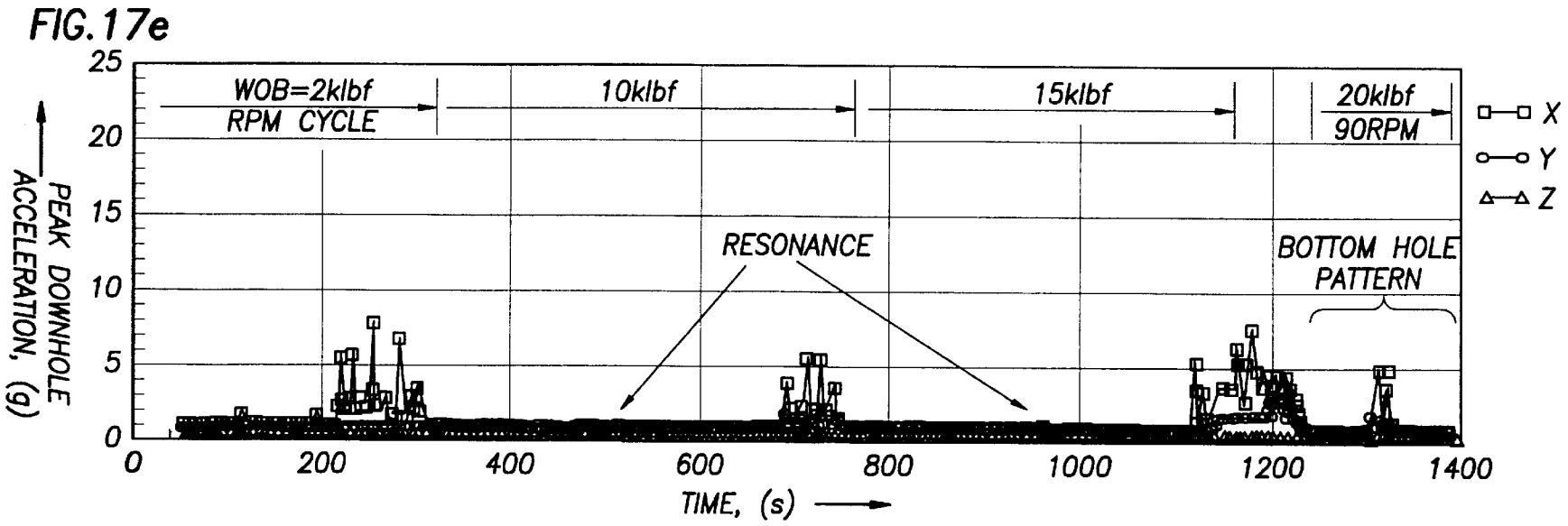
FIG. 17*e* illustrates peak acceleration versus time for a roller cone bit versus time for a roller cone bit with the sensors placed even closer to the earth's surface than the placements for the data of FIG. 17*d;*

The surface behavior for the roller cone bit tests was much more eventful than for the conventional PDC tests. FIG. 16*b* shows that for 2 klbf WOB the axial vibrations at the surface gradually increased with rotary speed. When WOB was increased to 10 klbf the axial accelerations increased until a dramatic peak was reached at 75 RPM. At this combination of weight and rotary speed the suspension was bouncing quite severely. It is interesting to note that while the vibrations at the surface were quite dramatic, amplitudes downhole were very small. When the rotary speed was increased the surface vibrations quickly subsided. The same type of behavior was observed when the WOB was further increased to 20 klbf, although for this case the severe vibrations appeared at 90 RPM. At this higher WOB the tangential accelerations downhole displayed a peak of 25 g, which corresponded to dramatic torsional oscillations at the surface. The severe axial vibrations of the swivel corresponded with small axial peaks downhole.

Figure 18A:
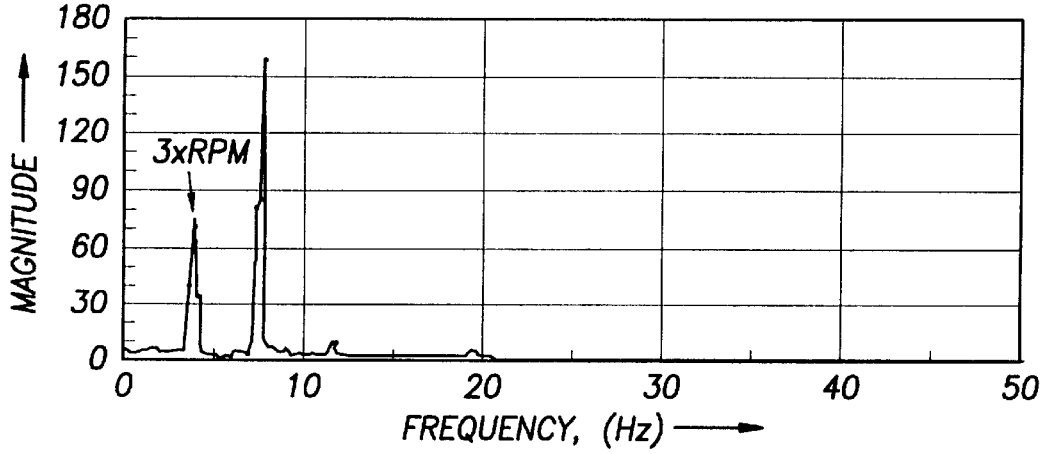
FIG. 18 graphically illustrates frequency versus amplitude measured during severe surface vibrations of a roller cone bit.
Figure 18B:
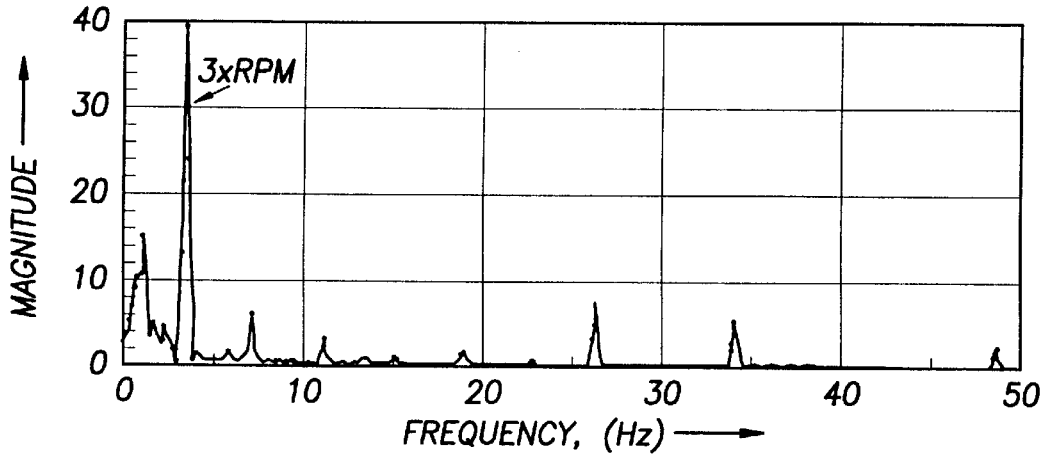
Figure 18C:
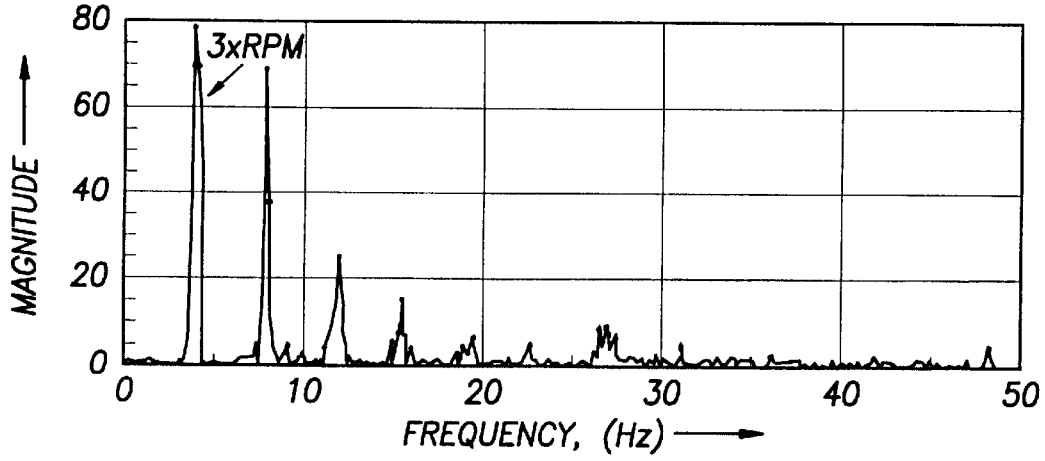
Figure 19:
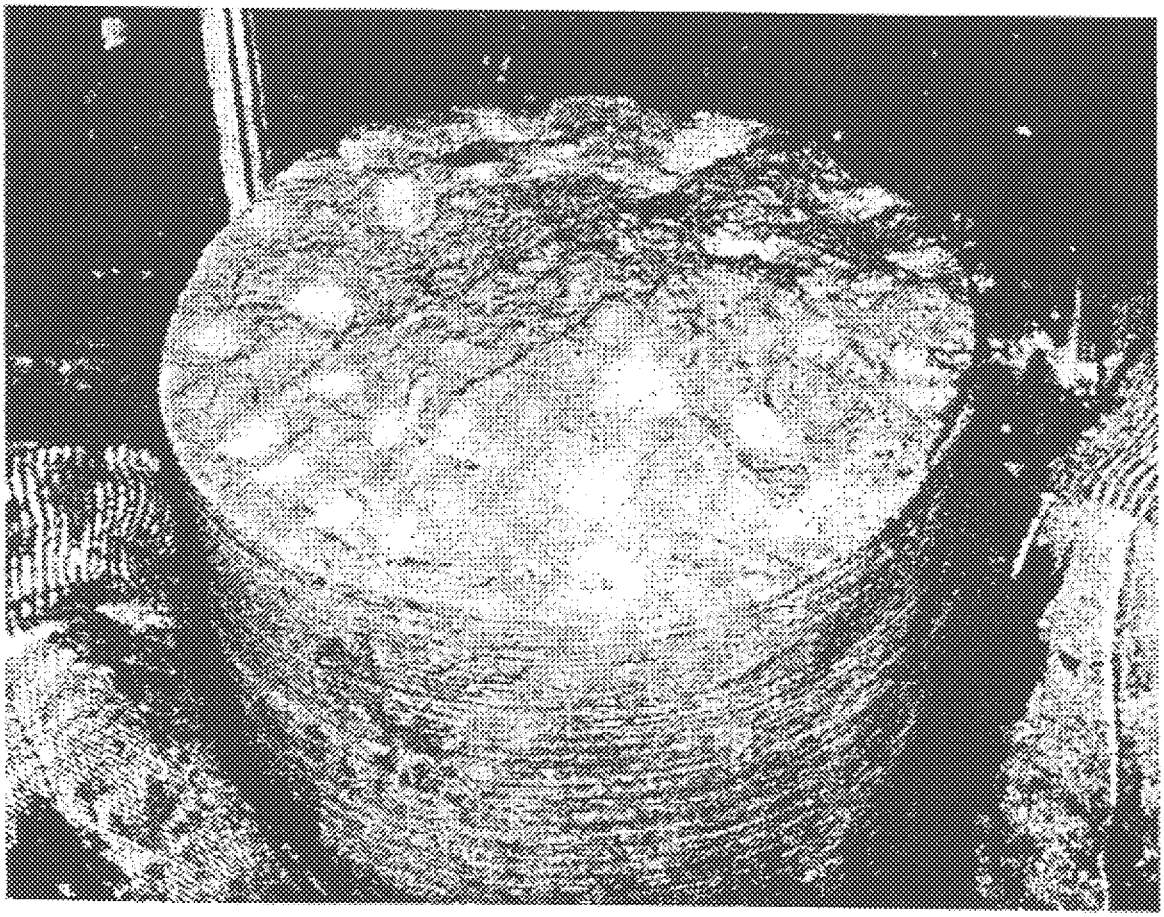
FIG. 19 is a bottom hole pattern resulting from the roller cone bit associated with the data illustrated in FIG. 17*e;*

The onset of the severe surface vibrations at a given rotary speed, and their rapidly diminishing amplitude when any other rotary speed was used, suggested that a resonant phenomenon occurred. Analysis of the drill string suggested that it was not excited at a natural frequency, so the power swivel and its suspension system were evaluated. The natural frequency was found by measuring axial acceleration and force while allowing the swivel to free fall for a short distance and then slamming on the brake. Results showed values which varied from 3.85 Hz to 4.2 Hz depending on hoist position. The natural frequency for a given hoist position was found to match 3 times RPM whenever resonance was encountered during tests, and this suggested that the axial vibration usually associated with 3-cone bits was indeed present. FIG. 18 verifies this, as oscillations in WOB, swivel acceleration, and torque during the last resonant event in FIG. 17*e* contain strong 3 times RPM components. This was also the case for high rate downhole axial acceleration measurements. The bottom hole pattern left from the resonant event was retrieved, and is shown in FIG. 19. Although some relief is clearly present, a cammed surface is not obvious.

Thus, the preferred embodiment of the present invention contemplates that:

a) a downhole vibration sensor be placed very close to the bit, perhaps even in the bit;

b) the downhole sensor includes at least one accelerometer to measure the lateral acceleration of the bit;

c) the lateral acceleration be used to quantify the level of lateral vibration; and d) a frequency analysis be performed upon the lateral acceleration to obtain the frequency having the highest magnitude.

It is important to an understanding of the present invention to appreciate the fact of the key to detecting backward whirling (as contrasted with other lateral vibrations) is to understand that harmonic vibration is a distinctive characteristic of whirling motions. If the magnitude at the peak frequency is higher than a predetermined level (i.e., 1 $g^2$/Hz), the bit is backwardly whirling, and the whirling frequency is the peak frequency minus the rotary speed of the bit. The predetermined level, expressed in dimensions of "$g^2$/Hz", will typically be based upon empiracal results. This fact is also true of BHA whirl.

To better understand the foregoing, one should consider the following: During bit whirl, assuming that the whirling radius (R) is constant and the impact forces between the BHA and the borehole wall are small, the two lateral measurements (X and Y) from the sensor sub can be written as $$X=R\Omega^2 \cos(\omega-\Omega)t-R\Omega' \sin(\omega-\Omega)t-r\omega^2 \quad (1a)$$

$$Y=R\Omega^2 \sin(\omega-\Omega)t+R\Omega' \cos(\omega-\Omega)t+r\acute{\omega} \quad (1b)$$

in which

R is the whirling radius,

Ω is the whirling frequency,

Ω' is the time derivative of Ω r is the distance between the center of drill collar and the accelerometers (in this case, r=1.64"), ω is the angular velocity or the RPM, and ω is the time derivative of ω.

Therefore, the analytical model predicts that (1) No Whirl: R=O and Ω=O, no harmonic vibration (2) Forward Whirl: Ω=ω, no harmonic vibration.

(3) Backward Whirl: harmonic vibrations occur in the two lateral motions of the bit.

The direction of the backward whirling motion is opposite to the rotation of the bit, thus the whirling frequency is the measured frequency (by the DDS) minus the rotary speed of the bit. In addition, the X and Y accelerometers should measure the same level of accelerations and the same frequency, (ω−Ω). Therefore, one of the measurements is redundant. It is preferred to use the Y data because it is normally slightly larger than the X's due to the chipping forces created during bit whirl.

Again, it should be appreciated that this analytical model is true for both bit whirl and BHA whirl.

The concept was tested in the laboratory and in commercial field tests as explained above, but which are reiterated here for purposes of a summary comparison:

No Whirl: Anti-Whirl PDC bit in Hard Rock

Figure 20:
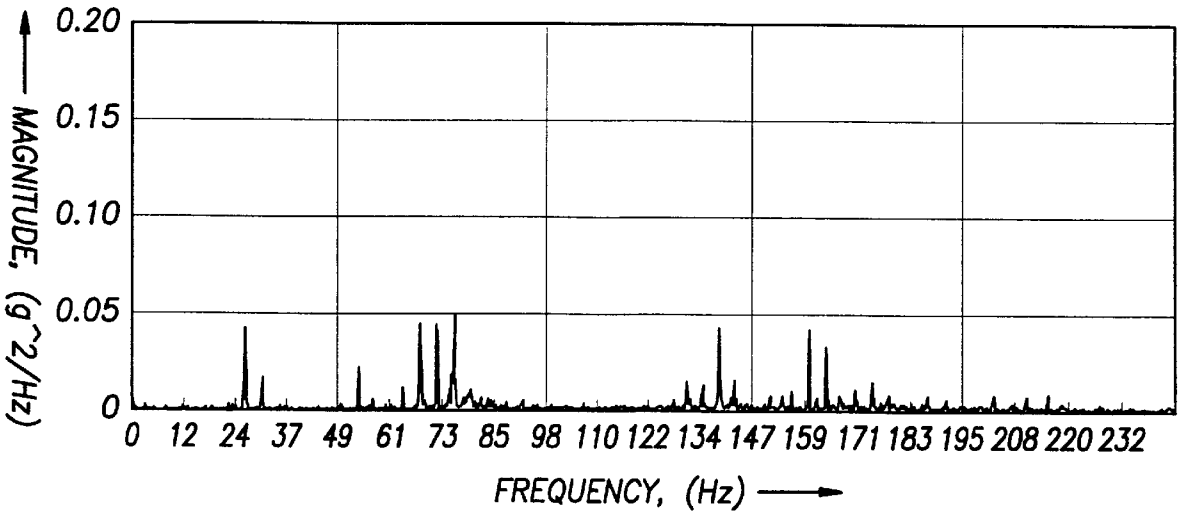
FIG. 20 graphically illustrates the power spectra of the Y acceleration measured for an anti-whirl bit in hard rock.

A gauge hole and a bottom hole pattern with concentric circles was created by the anti-whirl PDC bit indicating that the center of rotation was stable at the center of the hole as the bit was rotating. FIG. 20 shows the frequency spectrum of the Y acceleration acquired while drilling with an anti-whirl PDC bit through a hard rock. The fairly broad spectrum (all in small magnitude) is a result of non-periodic oscillation or non-whirling motion.

Backward Whirl: 4-bladed PDC Bit in Soft Rock

Figure 21:
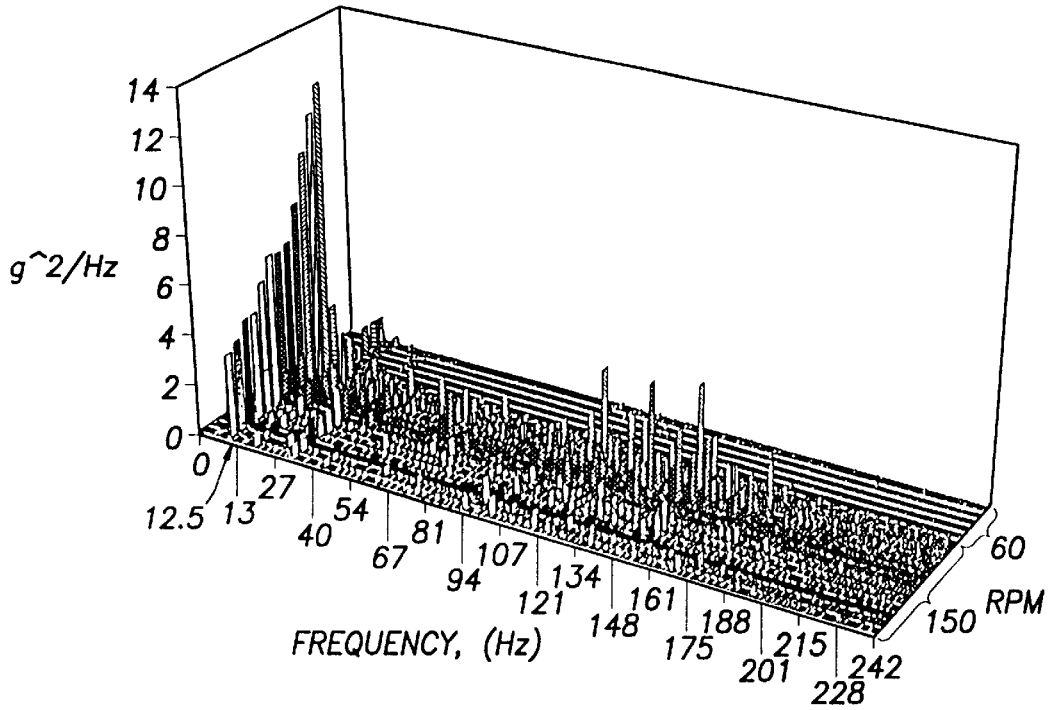
FIG. 21 graphically illustrates the power spectra of the Y acceleration measured for a conventional PDC bit in soft rock.

FIG. 21 shows the frequency spectra of the Y acceleration acquired while drilling a 4-bladed PDC bit through a soft rock. The rotary speed was started at 150 RPM, the dominant frequency was at 12.5 Hz. Using Eq. 1, where $\omega$=2.5 Hz, the whirling frequency ($\Omega$)=10 Hz (4 times RPM) as expected for a 4-bladed bit. The steady peak frequency and the high magnitude were evidence of a pure backward whirling motion. This harmonic vibration (bit whirl) was broken down when the RPM was decreased from 150 to 60.

Backward Whirl 4-bladed PDC Bit in Hard Rock

Figure 22:
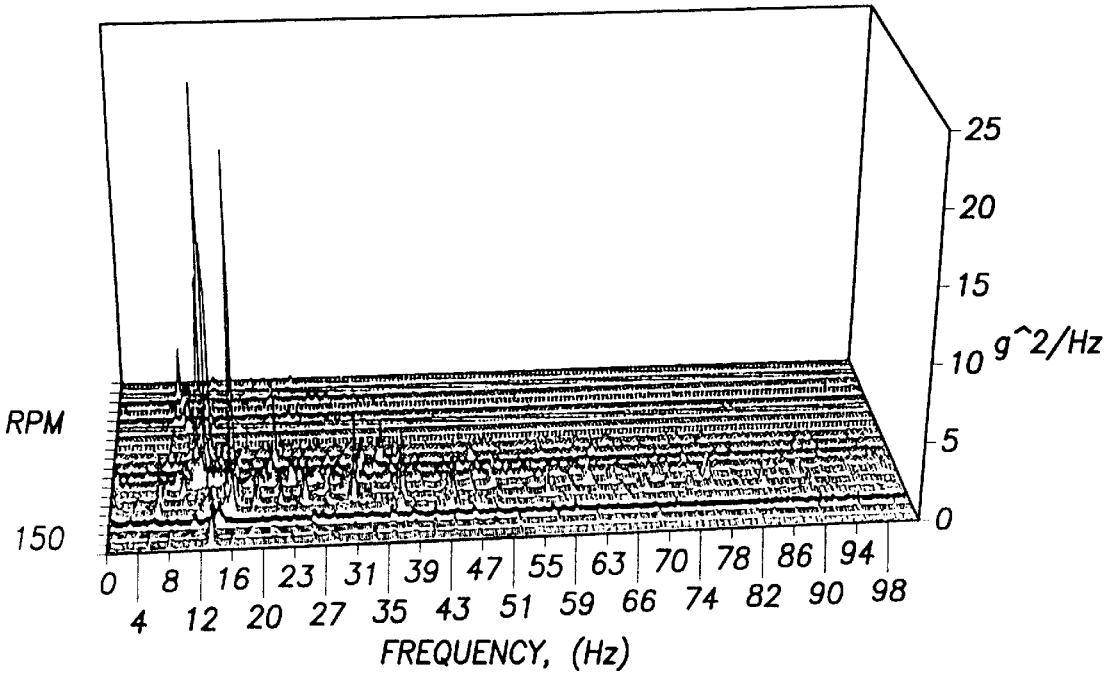
FIG. 22 graphically illustrates the power spectra of the Y acceleration measured for a convetional PDC bit in hard rock.

FIG. 22 shows the frequency spectra for the same PDC bit drilling in a hard rock. Due to higher vibrational energy created in the hard rock, the magnitude of the spectra was greater than that in FIG. 21. However, the peak frequency was varying with time in the range between the 7.5 Hz and 30 Hz even when the rotary speed had been kept constant at 150 RPM. The unsteady whirling frequency implies that the PDC bit whirl in hard rock is a non-stationary motion.

Backward Whirl: Tri-Cone Bit in Hard Rock

Figure 23:
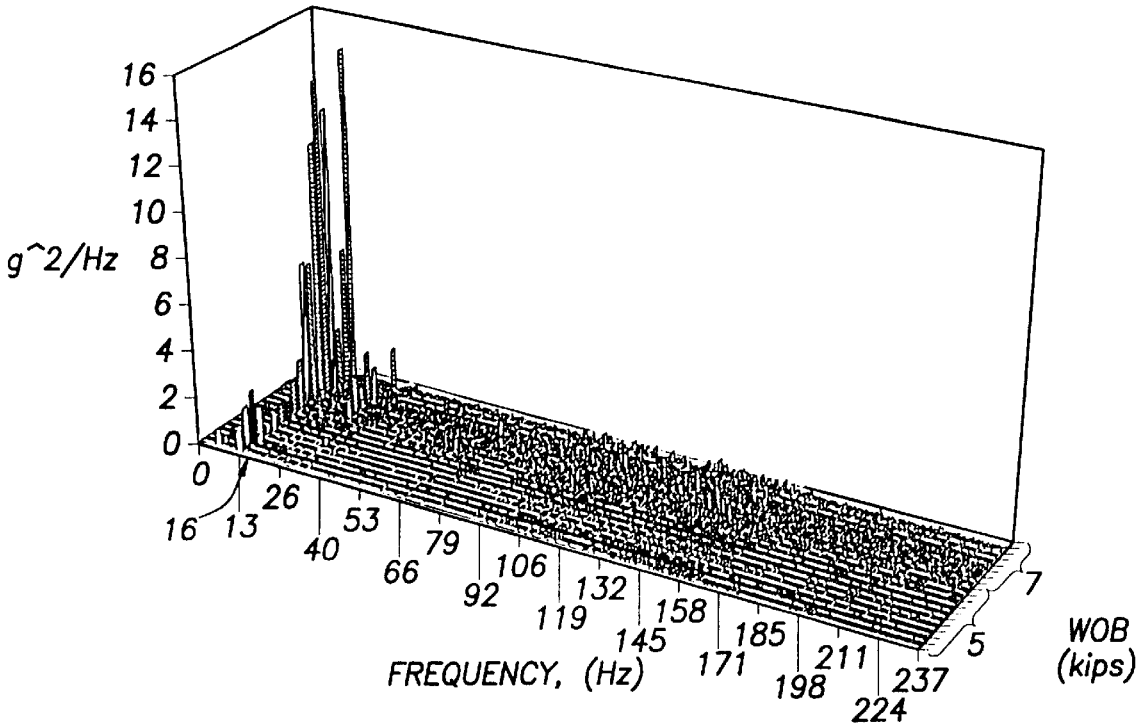
FIG. 23 graphically illustrates the power spectra of the Y acceleration measured for a roller cone bit (three cones) in hard rock.

FIG. 23 shows the frequency spectra of the Y acceleration while drilling with the tri-cone bit in a hard rock at 240 RPM (4 Hz). The dominant frequency measured at 16 Hz indicates that the whirling frequency was 16−4=12 Hz or 3 times the RPM. When the WOB was increased from 5 kips to 7 kips, the whirling frequency did not change although the whirling energy was increased significantly.

Backward Whirl: Tri-Cone Bit in Soft Rock

Figure 24:
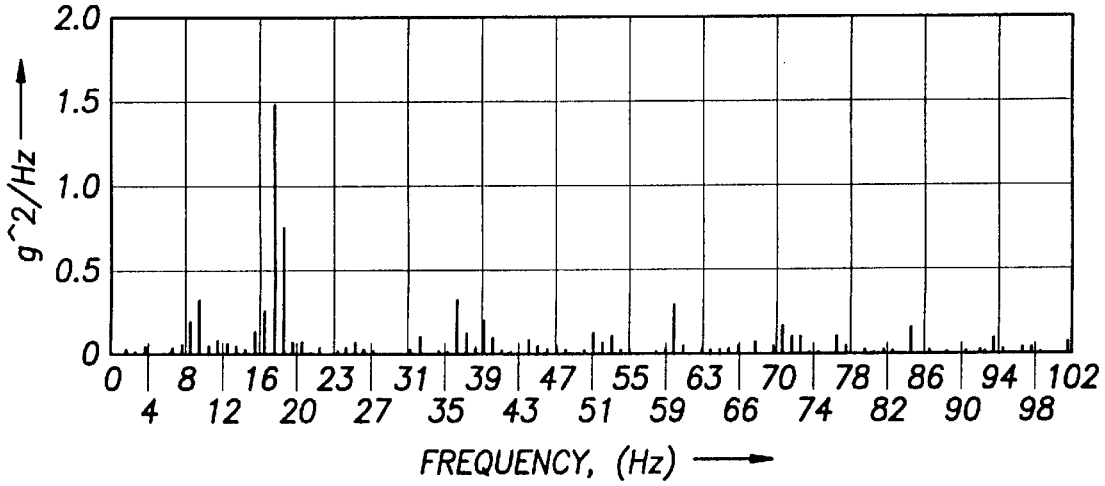
FIG. 24 graphically illustrates the power spectra of the Y acceleration measured for a roller cone bit (three cones) in soft rock.

FIG. 24 shows the frequency spectrum of the Y acceleration for the same tri-cone bit drilling in a soft rock. Clearly, using the same operating parameters (WOB=, RPM=240) in the soft rock, the tri-cone bit was still whirling at 3 times the RPM (16−4=12 Hz). However, the magnitude of the peak was smaller as a result of lower vibrational energy in the soft rock.

Figure 25:
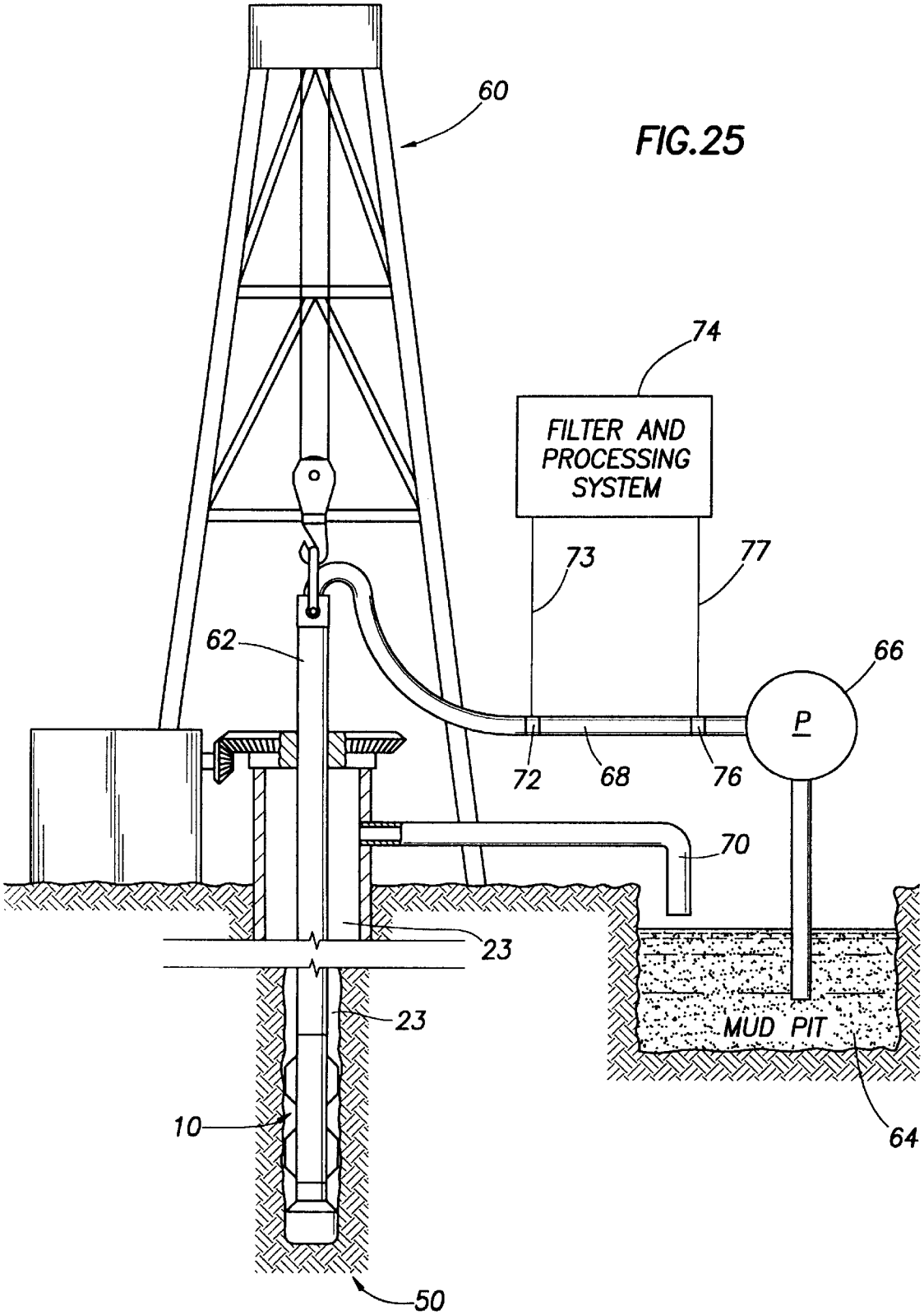
FIG. 25 pictorially illustrates, in elevation, a drilling rig drilling an earth borehole, having the downhole logging sub within the drillstring in accord with the present invention.

Referring now to FIG. 25, there is illustrated, schematically, a drilling rig 60 having a string 62 of drill pipe and drill collars which is suspended in the earth formation 50, and which has a drill bit, which may be a PDC or roller bit, at its lower end for drilling the earth formation 50. The drilling fluid is picked up from the mud pit 64 by pump 66, which may be of the piston reciprocating type, and circulated through the stand pipe 69, down through the drill string 62, out through the exit port of the drill bit, and back to the earth's surface in the annulus 23 between the drill string 62 and the wall of the well bore. Upon reaching the surface, the drilling fluid (the "mud") is discharged through the line 70 back into the mud pit where cuttings of rock or other well debris are allowed to settle out before the mud is recirculated. A piezoelectric pressure transducer 72 is placed in the standpipe 68, the output of such transducer being connected to the filtering and processing system 74 explained in more detail hereinafter. A pump stroke counter transducer 76 is also placed in the standpipe 68, the output ot such transducer 76 also being connected into the system 74.

Included within the drillstring 62 is a logging sub 10 having three orthogonally positioned accelerometers, mounted on X, Y and Z axes, for measuring the vibration being experienced near the drill bit. The logging sub 10 also has a conventional valve (not illustrated) driven by the accelerometers and their related circuitry which causes drilling fluid to be dumped into the annulus 23 in a conventional, MWD, negative pulsing system well known in the art, and which need not be described in any more detail, except to say that the negative pressure pulses reflective of the three accelerometers are detected by the transducer 72 to thereby enable the signal processing systems at the earth's surface to be inputted, in real time, indicative of the vibrations measured downhole by such accelerometers. The line 77 from the second pressure transducer 76 drives the input of a conventional digital stroke signal circuit within the system 74.

The logging sub 10 also contains conventional spectral analysis circuitry (not illustrated) which measures the frequency of the lateral acceleration having the highest magnitude and the magnitude itself of the lateral acceleration along the X and/or Y axes, which is then converted into negative pressure pulses to be sensed by the detector 72 at the earth's surface in the conventional manner.

Thus, in practicing the invention, as the drillstring 62 of FIG. 25 penetrates the earth formations 50, the frequency having the highest magnitude and the magnitude itself of the measured lateral vibrations are monitored, and transmitted to the signal processing circuitry at the earth's surface. In the event the magnitude of the lateral vibration exceeds a predetermined value, being indicative of backward whirling, the WOB, rotary speed or other drilling parameters can then be varied to reduce or eliminate such backward whirling.

What is claimed is:

1. A method of detecting the destructive vibration of a drilling component in a borehole, comprising:

monitoring the acceleration magnitude and the frequency of the lateral vibration of said drilling component using MWD techniques with vibration transducers located in or near said drilling component wherein said lateral vibration is measured in X and/or Y coordinates acording to the relationship:

$$X=R\Omega^2 \cos(\omega-\Omega)t-R\Omega' \sin(\omega-\Omega)t-r\omega^2$$

$$Y=R\Omega^2 \sin(\omega-\Omega)t+R\Omega' \cos(\omega-\Omega)t+r\acute{\omega}$$

which R is the whirling radius, $\Omega$ is the whiring frequency, $\Omega'$ is the time derivative of $\Omega$, r is the distance between the center of the drilling component and the accelerometers, $\omega$ is the angular velocity or the RPM, and $\omega$ is the the derivative of $\omega$;

determining the acceleration magnitude of the lateral vibration of said drilling component;

determining the peak of the power spectrum of the acceleration magnitude occurring in the frequency domain in said lateral vibration;

comparing said peak magnitude with a threshold magnitude in said frequency domain indicative of the possible onset of destructive vibration of said drilling component; and signalling onset or the occurrence of destructive vibration of said drilling component when said peak magnitude in said frequency domain reaches or exceeds said threshold magnitude.

2. A method as defined in claim 1 wherein said drilling component is a drill bit.

3. A method as defined in claim 1 wherein said drilling component is a drill bit.

4. A method as defined in claim 1, further comprising the step of altering one or more drilling parameters associated with said drilling component to reduce or terminate said destructive vibration.

5. A method as defined in claim 4 wherein said drilling parameters include one or more of the following variables:

weight on bit, rotary speed, bit configuration, bit design, bottom hole assembly configuration, or well hydraulics.

6. A method as defined in claim 4 wherein said drilling component is a drill bit.

7. A method as defined in claim 1, further comprising:

monitoring lateral vibration of said drilling component using one or more accelerometers mounted in a logging sub connected to said drilling component.

8. A method as defined in claim 7 wherein said drilling component is a drill bit.

9. A method as defined in claim 1, further comprising:

evaluating the power spectrum of said acceleration magnitudes occurring in the frequency domain for harmonic vibration signalling the occurrence of backward whirling of said drilling component when said harmonic vibration is detected.

10. A method as defined in claim 9 wherein said drilling component is a drill bit.

11. A method as defined in claim 9, further comprising evaluating the occurrence of destructive vibration in said drilling component when said backward whirling frequency falls below a predetermined minimum value.

12. A method as defined in claim 11 wherein said drilling component is a drill bit.

13. A method as defined in claim 11 wherein said backward whirling frequency and the power spectrum of said peak acceleration magnitude in said frequency domain are both evaluated to determine the existence of destructive vibration in said drilling component.

14. A method as defined in claim 13 wherein said drilling component is a drill bit.

15. A method as defined in claim 3 wherein said X and/or said Y measurements are evaluated for harmonic vibrations to determine the presence of backward whirl in said drilling component.

16. A method as defined in claim 15 wherein the frequency of said backward whirl is determined by subtracting said angular velocity $\omega$ from a measured frequency of vibration of said drilling component.

17. A method as defined in claim 16 wherein one or more drilling parameters associated with said drilling component is changed to reduce the whirling energy of said drilling component when said whirling frequency occurs below a predetermined frequency value.

* * * * *

UNITED STATES PATENT AND TRADEMARK OFFICE

CERTIFICATE OF CORRECTION

PATENT NO. : 5,864,058

DATED : January 26, 1999

INVENTOR(S) : Chen-Kang David Chen

It is certified that error appears in the above-identified patent and that said Letters Patent is hereby corrected as shown below:

In col. 14, l. 39 (claim 1), insert --in-- before "which".
In col. 14, l. 60 (claim 3), delete "claim 1" and insert therefor --claim 4--.
In col. 15, l. 3 (claim 6), delete "claim 4" and insert therefor --claim 13--.
In col. 15, l. 17 (claim 10), delete "claim 9" and insert therefor --claim 5--.
In col. 16, l. 6 (claim 14), delete "claim 13" and insert therefor --claim 9--.
In col. 16, l. 8 (claim 15), delete "claim 3" and insert therefor --claim 1--.

Signed and Sealed this

Fourteenth Day of September, 1999

*Attest:*

Q. TODD DICKINSON

*Attesting Officer*

*Acting Commissioner of Patents and Trademarks*